US011708747B2

(12) United States Patent
Dahl et al.

(10) Patent No.: US 11,708,747 B2
(45) **Date of Patent: *Jul. 25, 2023**

(54) OPEN-HOLE PRESSURE TIGHT MULTILATERAL JUNCTION

(71) Applicant: Halliburton Energy Services, Inc., Houston, TX (US)

(72) Inventors: Espen Dahl, Stavanger (NO); Morten Falnes, Sola (NO); Gavin Lafferty, Peterhead (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/492,295

(22) Filed: Oct. 1, 2021

(65) Prior Publication Data

US 2022/0106860 A1 Apr. 7, 2022

Related U.S. Application Data

(60) Provisional application No. 63/086,912, filed on Oct. 2, 2020.

(51) Int. Cl.
*E21B 41/00* (2006.01)
*E21B 7/06* (2006.01)
(Continued)

(52) U.S. Cl.
CPC ..... *E21B 41/0042* (2013.01); *E21B 7/061* (2013.01); *E21B 43/103* (2013.01); *E21B 23/01* (2013.01); *E21B 23/0412* (2020.05)

(58) Field of Classification Search
CPC .... E21B 41/0042; E21B 7/061; E21B 43/103; E21B 23/01
See application file for complete search history.

(56) References Cited

U.S. PATENT DOCUMENTS 5,318,121 A * 6/1994 Brockman ..... E21B 7/061 166/117.6
5,595,247 A 1/1997 Braddick
(Continued)

FOREIGN PATENT DOCUMENTS

WO 02092962 A1 11/2002
WO 2006092545 A1 9/2006

*Primary Examiner* — Yong-Suk (Philip) Ro
(74) *Attorney, Agent, or Firm* — Scott Richardson; Parker Justiss, P.C.

(57) ABSTRACT

Provided, in one aspect, is a well system and a method for forming a well system. The well system, in one aspect, includes a main wellbore, the main wellbore having a main wellbore open hole section, and a lateral wellbore extending from the main wellbore, the lateral wellbore having a lateral wellbore open hole section. The well system, according to this aspect, further includes a main bore completion located within the main wellbore and a lateral bore completion located within the lateral wellbore, and a multilateral junction positioned at an intersection between the main wellbore open hole section of the main wellbore and the lateral wellbore open hole section of the lateral wellbore, the multilateral junction including a main bore leg forming a first pressure tight seal with the main bore completion and a lateral bore leg forming a second pressure tight seal with the lateral bore completion such that the main bore completion and the lateral bore completion are hydraulically isolated from one another.

20 Claims, 21 Drawing Sheets

(51) Int. Cl.

| | |
|---|---|
| ***E21B 43/10*** | (2006.01) |
| *E21B 23/01* | (2006.01) |
| *E21B 23/04* | (2006.01) |

(56) References Cited

U.S. PATENT DOCUMENTS

| | | | | |
|---|---|---|---|---|
| 5,697,445 | A | 12/1997 | Graham | |
| 5,730,224 | A * | 3/1998 | Williamson | E21B 23/12 166/117.6 |
| 6,896,052 | B2 | 5/2005 | Simpson et al. | |
| 7,104,322 | B2 | 9/2006 | Whanger et al. | |
| 7,172,027 | B2 | 2/2007 | Simpson et al. | |
| 7,377,328 | B2 | 5/2008 | Dewey et al. | |
| 8,061,423 | B2 | 11/2011 | Lohbeck | |
| 9,249,559 | B2 * | 2/2016 | Dyer | E21B 41/0035 |
| 9,353,606 | B2 | 5/2016 | Bruce et al. | |
| 10,196,880 | B2 * | 2/2019 | Steele | E21B 23/12 |
| 10,718,183 | B2 | 7/2020 | Bruce et al. | |
| 2003/0085038 | A1 | 5/2003 | Restarick et al. | |
| 2005/0016740 | A1 | 1/2005 | Aldaz et al. | |
| 2010/0155083 | A1 | 6/2010 | Lynde et al. | |
| 2011/0036576 | A1 | 2/2011 | Schultz et al. | |
| 2012/0273236 | A1 | 11/2012 | Gandikota et al. | |
| 2013/0221843 | A1 * | 8/2013 | Cheatham, III | H01J 29/02 977/939 |
| 2015/0068756 | A1 | 3/2015 | Pendleton | |
| 2015/0176378 | A1 * | 6/2015 | Ramey, Jr. | E21B 41/0035 166/387 |
| 2016/0145956 | A1 | 5/2016 | Dahl et al. | |
| 2016/0326818 | A1 * | 11/2016 | Lajesic | E21B 23/01 |
| 2016/0326849 | A1 | 11/2016 | Bruce et al. | |
| 2016/0341011 | A1 * | 11/2016 | Steele | E21B 33/13 |
| 2017/0234090 | A1 | 8/2017 | Egleton et al. | |
| 2019/0330944 | A1 | 10/2019 | Crabb et al. | |

* cited by examiner

OPEN-HOLE PRESSURE TIGHT MULTILATERAL JUNCTION

CROSS-REFERENCE TO RELATED APPLICATION

This application claims the benefit of U.S. Provisional Application Ser. No. 63/086,912, filed on Oct. 2, 2020, entitled "METHOD OF USING EHS TECHNOLOGY FOR ANCHORING DOWNHOLE EQUIPMENT," commonly assigned with this application and incorporated herein by reference in its entirety.

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section) with a running tool. The deflector assemblies are often laterally and rotationally fixed within the main wellbore using a wellbore anchor.

BRIEF DESCRIPTION

Reference is now made to the following descriptions taken in conjunction with the accompanying drawings, in which.

DETAILED DESCRIPTION

Figure 1:
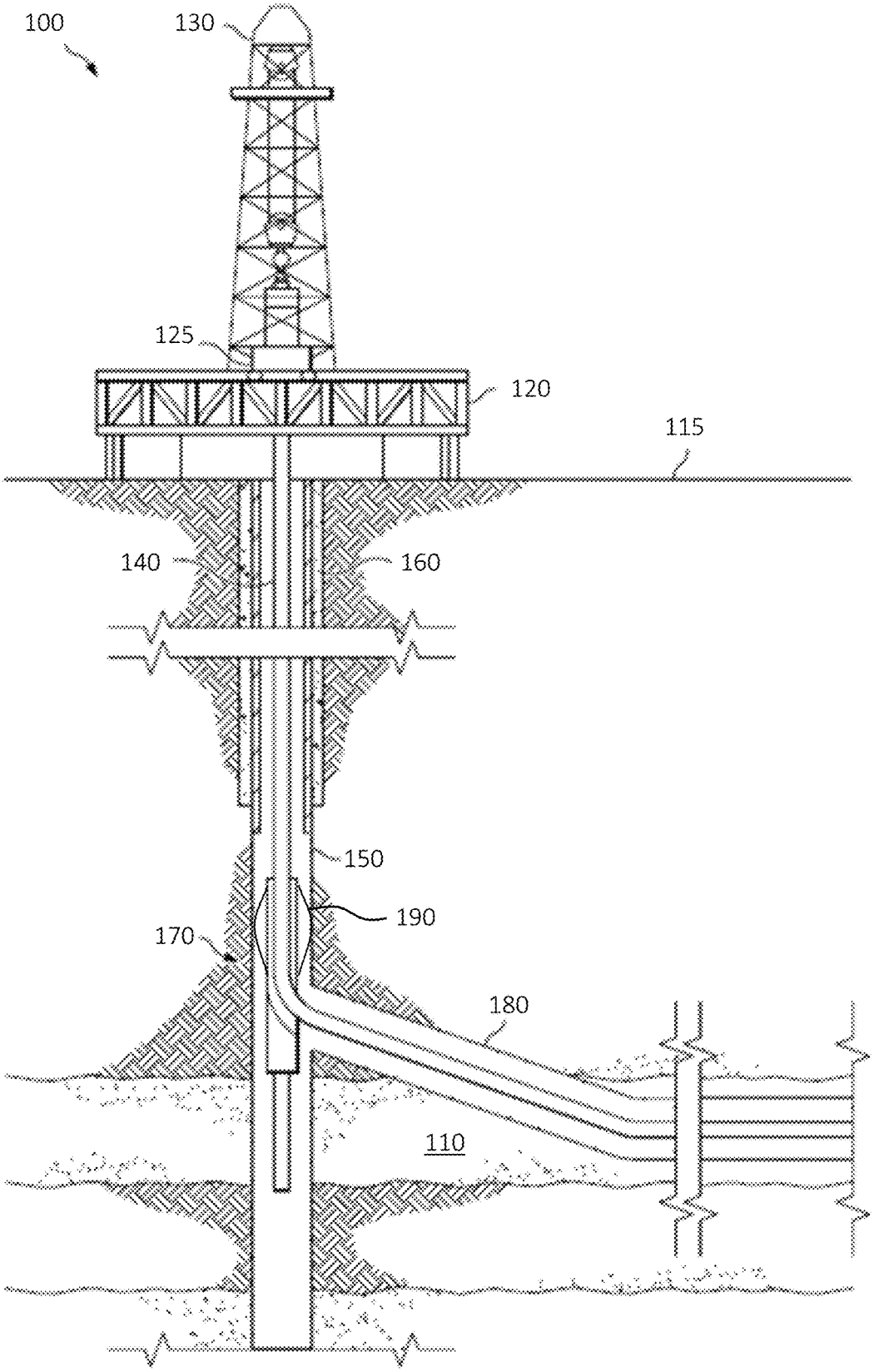
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The disclosure describes a new method for anchoring equipment in a wellbore. The deflector assembly is used to start a second hole section from the first section, consequently creating an open hole junction at the deflector assembly. The term "open hole", as used herein, means that at least that section of the wellbore includes no casing, thereby exposing the subterranean formation. The junction may be later completed with a pressure tight TAML (Technology Advancements of Multi-Laterals) level 5 junction. In certain situations, no cement surrounds the multilateral junction, but in other situations, cement may surround at least a portion of the multilateral junction. In one or more embodiments, both the open hole wellbore anchor and the open hole deflector assembly can be produced there through.

Open hole wellbore anchors do exist in the marketplace, but usually feature an anchoring mechanism that spans a relatively short distance or with a setting range limiting the application to wellbores with little variance in internal diameter (ID). A wellbore anchor designed according to the present disclosure may have a setting range of 15% or more of the run-in-hole diameter. For example, if the wellbore anchor were to have a diameter (x) when run in hole, the expanded diameter (x') could be 1.15× or more (e.g., 8.5" to 10" or more). Washed out/caved in areas or uneven ID in general is often seen when surveying a drilled section and finding a suitable location/depth for an open hole anchor can thus be difficult. Furthermore, the traditional open hole wellbore anchor relies on a certain formation strength of the rock in order to hold the required axial and torsional loads.

There are no other open hole wellbore anchors that offer the same wellbore contact (contact area) or setting range as envisaged with the disclosed wellbore anchor. The contact area is believed to provide superior axial and torsional ratings. Since the disclosed wellbore anchor, in at least one embodiment, is activated by pressurized fluid in two or more separate chambers that spans several meters or more across the length of the anchor, it is believed to conform to any irregularities in the wellbore and is thus less sensitive to an even internal diameter (ID) in the setting area. Furthermore, by design the disclosed wellbore anchor will help supporting and stabilizing the formation by exerting pressure against the wellbore ID, thereby making it less sensitive to weaker formations compared to a mechanical anchor, which to a larger degree relies on a competent formation. A wellbore anchor according to the present disclosure provides the ability to have communication from tubing to annulus, if required, even after being set, which is not known in the art. This feature offers the ability to perform circulation of fluid and/or a return path for pumping cement operation.

An alternative setting method could be to have a tail pipe below the running tool, which straddles the setting ports/valve assembly of the wellbore anchor. It is envisioned that an elastomeric element could be added to an alternate wellbore anchor design if an annular seal would be required.

The proposed method may prove useful in applications where equipment such as a whipstock needs to be run through a restriction and anchored in a larger ID below the restriction (e.g., through-tubing applications, where a new lateral is drilled from an existing production tubing). Downhole equipment is required to pass through upper completion restrictions and set in the tubing ID deeper in the well.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock 170 according to one or more embodiments of the present disclosure may be positioned at a location in the main wellbore 150. Specifically, the whipstock 170 could be placed at a location in the main wellbore 150 where it is desirable for a lateral wellbore 180 to exit. Accordingly, the whipstock 170 may be used to support a milling tool used to penetrate a window in the main wellbore 150, and once the window has been milled and a lateral wellbore 180 formed, in some embodiments, the whipstock 170 may be retrieved and returned uphole by a retrieval tool, in some embodiments in only a single trip.

In some embodiments, an anchor 190 may be placed downhole in the wellbore 150 to support and anchor downhole tools, such as the whipstock 170, for maintaining the whipstock 170 in place while drilling the lateral wellbore 180. The anchor 190, in accordance with the disclosure, may be employed in an open-hole section of the main wellbore 150, or alternatively in cased section of the main wellbore 150. As such, the anchor 190 may be configured to resist at least 6,750 newton meters (Nm) (e.g., about 5,000 lb-ft) of torque. In yet another embodiment, the anchor 190 may be configured to resist at least 13,500 newton meters (Nm) (e.g., about 10,000 lb-ft) of torque, and in yet another embodiment configured to resist at least 20,250 newton meters (Nm) (e.g., about 15,000 lb-ft) of torque. Similarly, the anchor 190 may be configured to resist at least 1814 kg (e.g., about 4,000 lb) of axial force. In yet another embodiment, the anchor 190 may be configured to resist at least 4536 kg (e.g., about 10,000 lb) of axial force, and in yet another embodiment the anchor 190 may be configured to resist at least 6804 kg (e.g., about 15,000 lb) of axial force. The anchor 190 may include, in some aspects, a base pipe and two or more activation chambers disposed radially about the base pipe. The two or more activation chambers may be configured to move from a first collapsed state while running in hole, to a second activated state once the anchor 190 is positioned within the main wellbore 150.

In some embodiments, the anchor 190 may be hydraulically activated. Once the anchor 190 reaches a desired location in the main wellbore 150, fluid pressure may be applied to the two or more hydraulic activation chambers to move the two or more hydraulic activation chambers from the first collapsed state to the second activated state and engage a wall of the main wellbore 150. The anchor 190 may also include, in some embodiments, an expandable medium positioned radially about the two or more hydraulic activation chambers. In some aspects, the expandable medium may be configured to grip and engage the wall of the main wellbore 150 when the two or more hydraulic activation chambers are in the second activated state.

In at least one embodiment, the resulting main wellbore 150 has a main wellbore open hole section, and the resulting lateral wellbore 180 has a lateral wellbore open hole section. Further to this embodiment, the main wellbore 150 may have a main wellbore completion located therein, and the lateral wellbore 180 may have a lateral wellbore completion located therein. Accordingly, in at least one embodiment, a multilateral junction may be positioned at an intersection between the main wellbore open hole section of the main wellbore 150 and the lateral wellbore open hole section of the lateral wellbore 150. In accordance with one embodiment, the multilateral junction might include a main bore leg forming a first pressure tight seal with the main bore completion and a lateral bore leg forming a second pressure tight seal with the lateral bore completion such that the main bore completion and the lateral bore completion are hydraulically isolated from one another. What results, in one or more embodiments, is an open hole TAML Level 5 pressure tight junction.

Figure 2A:
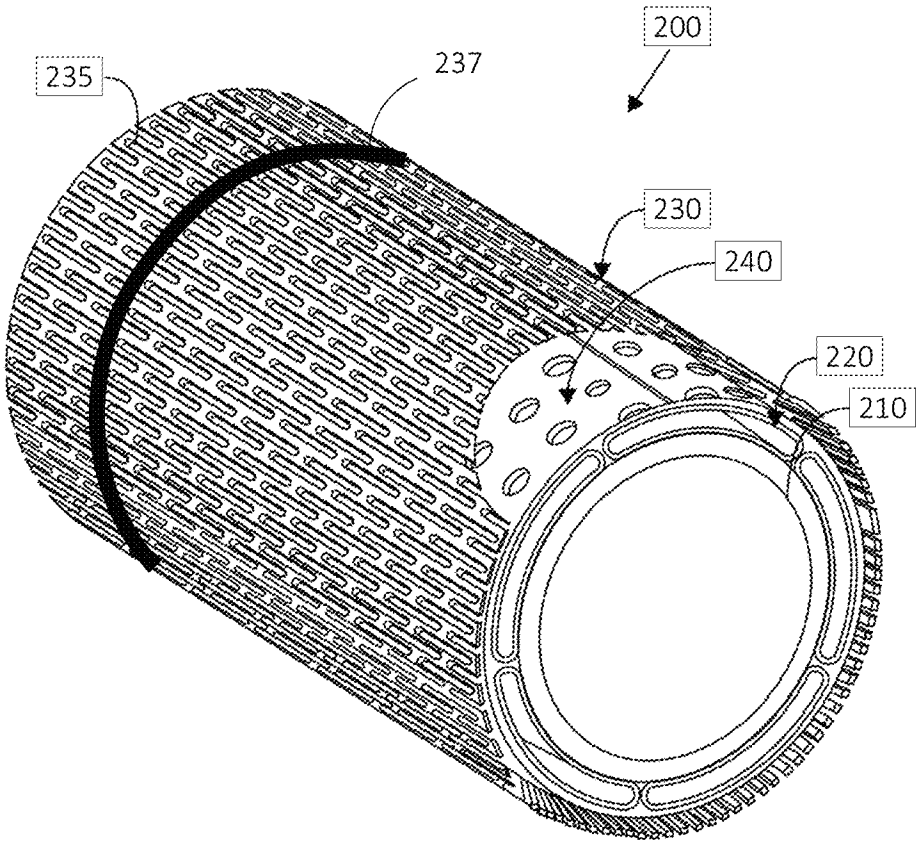
FIGS. 2A and 2B illustrate one embodiment of an anchor designed and manufactured according to one or more embodiments of the disclosure.
Figure 2B:
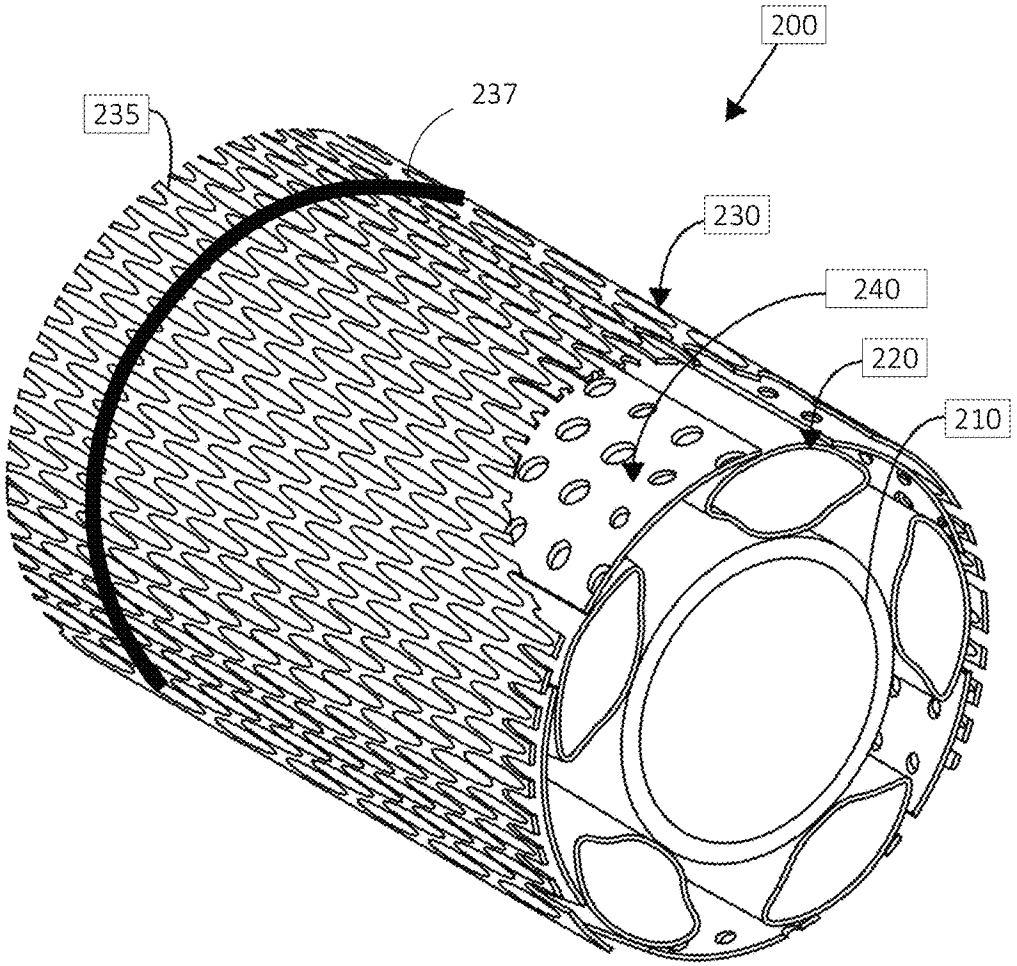

Turning now to FIGS. 2A and 2B, illustrated is one embodiment of an anchor 200 designed and manufactured according to one or more embodiments of the disclosure. FIG. 2A illustrates the anchor 200 in the collapsed state, whereas FIG. 2B illustrates the anchor 200 in the activated state. The anchor 200, in one embodiment, may include a base pipe 210. The base pipe 210, in at least on embodiment, is a metal base pipe. Nevertheless, other embodiments exist wherein a non-metal base pipe 210 is used.

In the embodiment of FIGS. 2A ad 2B, the base pipe 210 does not include openings connecting the interior of the base pipe 210 with the exterior of the base pipe 210. However, in yet other embodiments, a plurality of openings may exist between the interior of the base pipe 210 and the exterior of the base pipe 210. For example, a first plurality of openings could be used to provide fluid communication between the base pipe 210 and the two or more hydraulic activation chambers to move the two or more hydraulic activation chambers from the first collapsed state to the second activated state. In yet another embodiment, a second plurality of openings could be used to provide fluid communication between the base pipe 210 and an annulus surrounding the base pipe 210 when the two or more hydraulic activation chambers are in the second activated state.

While not shown in FIGS. 2A and 2B, in certain embodiments, the anchor 200 may include a valve coupled to the base pipe 210. In at least one embodiment, the valve has a first setting that closes fluid communication to the first plurality of openings and the second plurality of openings, a second setting that only opens fluid communication to the first plurality of openings, and a third setting that only opens fluid communication to the second plurality of openings.

Two or more hydraulic activation chambers 220 may be positioned radially about the base pipe 210. In some embodiments, the two or more hydraulic activation chambers 220 may be generally linearly aligned with one another. As used herein, generally linearly aligned may mean the two or more hydraulic activation chambers 220 may be linearly aligned within 10 percent of their length. In other embodiments, the two or more hydraulic activation chambers 220 may be substantially linearly aligned with each other, wherein the two or more two or more hydraulic activation chambers 220 may be linearly aligned within 5 percent of their length. In still other embodiments, the two or more hydraulic activation chambers 220 may be ideally linearly aligned, wherein the two or more two or more hydraulic activation chambers 220 may be linearly aligned within 1 percent of their length.

In other embodiments, the two or more hydraulic activation chambers 220 may be generally angularly aligned, substantially angularly aligned, or ideally angularly aligned with one another. The term "generally angularly aligned" as used herein, means that the two or more hydraulic activation chambers 220 are within 10 degrees of parallel with one another. The term "substantially angularly aligned" as used herein, means that the two or more hydraulic activation chambers 220 are within 5 degrees of parallel with one another. The term "ideally angularly aligned" as used herein, means that the two or more hydraulic activation chambers 220 are within 2 degrees of parallel with one another.

The two or more hydraulic activation chambers 220 may be configured to move from the first collapsed state shown in FIG. 2A to the second activated state shown in FIG. 2B to engage a wall of a wellbore. In some embodiments, when in the second activated state, the two or more hydraulic activation chambers 220 may be operable to handle at least 20.7 Bar (about 300 psi) of internal pressure in the second activated state to engage the wall of a wellbore. In some embodiments, when in the second activated state, the two or more hydraulic activation chambers 220 may be operable to handle at least 27.6 Bar (about 400 psi) of internal pressure in the second activated state to engage the wall of a wellbore. In some embodiments, when in the second activated state, the two or more hydraulic activation chambers 220 may be operable to handle at least 51.7 Bar (about 750 psi) of internal pressure in the second activated state to engage the wall of a wellbore. In some alternative embodiments, when in the second activated state, the two or more hydraulic activation chambers 220 may be operable to handle at least 68 Bar (about 1000 psi) of internal pressure in the second activated state to engage the wall of a wellbore.

In some embodiments, the anchor 200 may include an expandable medium 230, which may be positioned radially about the two or more hydraulic activation chambers 220. In certain embodiments, the expandable medium 230 may be configured to split apart or deform as the two or more hydraulic activation chambers 220 expand into the second activated state such that the expandable medium 230 may thereafter engage and dig into the wall of the wellbore. In at least one embodiment, the expandable medium 230 is an exterior sleeve. In at least one other embodiment, the expandable medium 230 is a non-filter medium, and thus does not function to filter sand or other similar particulate matter.

The expandable medium 230 may include openings 235 therein. The openings 235, in certain embodiments, allow for the expandable medium 230 to easily expand. The general size and shape of the openings 235 may vary greatly and remain within the scope of the disclosure. In at least one embodiment, the openings 235 are larger than the opening in a typical sand screen. For example, the openings 235 might have a mesh value of at least about 36 (e.g., 485 μm) or greater. In yet another embodiment, the openings 235 might have a mesh value of at least about 20 (e.g., 850 μm) or greater, or in yet another embodiment the openings 235 might have a mesh value of at least about 10 (e.g., 2,000 μm) or greater.

The expandable medium 230, in certain other embodiments, may include a textured surface on an outer surface thereof for engaging the wall of the wellbore. In certain instances, the textured surface has a plurality of undulations, crenellations, corrugations, ridges, depressions, or other surface variations where the radial amplitude of the surface variation is at least about 1 mm (e.g., about 0.04 inches). In yet another embodiment, the radial amplitude of the surface variation is at least about 1.25 mm (e.g., about 0.05 inches), and in yet another embodiment the radial amplitude of the surface variation is between about 1.25 mm (e.g., about 0.06 inches) and about 25 mm (e.g., about 1.0 inches). Any known or hereafter discovered method for creating the textured surface is within the scope of the disclosure. The expandable medium 230 may comprise metals, carbide, polymers, and other materials used in downhole tool applications.

In some embodiments, an elastomeric element 237 may be positioned about the two or more hydraulic activation chambers 220, whether directly about the two or more hydraulic activation chambers 220, about the expandable medium 230, or form all or part of the expandable medium 230. In yet another embodiment, the elastomeric element 237 is an annular elastomeric element configured as an annular seal. The elastomeric element 237 (e.g., swellable elastomer in some embodiments) may be activated by temperature alone, fluid existing in the wellbore, completion fluid inserted into the wellbore, or any combination of the above. In an alternative embodiment, the elastomeric element 237 may be activated by a dedicated well treatment run to pump activation fluid to the elastomeric element 237.

In certain embodiments, two or more bridging plates 240 may be positioned radially about the two or more hydraulic activation chambers 220. The two or more bridging plates 240 may be configured to extend across at least a gap between outer portions of the two or more hydraulic activation chambers 220 when the two or more hydraulic activation chambers 220 are in the second activated state as shown in FIG. 2B. The two or more bridging plates 240 may be configured, in some aspects, to provide support for the expandable medium 230 positioned about the two or more hydraulic activation chambers 220. While it is illustrated that the two or more bridging plates 240 include openings therein, other embodiments may exist wherein the two or more bridging plates 240 do not include openings therein. Although not shown in the illustrated embodiment, certain embodiments of the two or more bridging plates 240 may include protrusions or a textured surface which may engage the wall of the wellbore, and in some embodiments, the protrusions may extend through the openings 235 in the expandable medium 230.

While the embodiment of FIGS. 2A and 2B illustrate the existence of the expandable medium 230 and the two or more bridging plates 240, other embodiments exist wherein the two or more hydraulic activation chambers 220 are fixed to the base pipe 210. In such an embodiment, the two or more hydraulic activation chambers 220 are unencumbered, and thus may engage directly with the wellbore when in the second activated state illustrated in FIG. 2B.

Figure 3B:
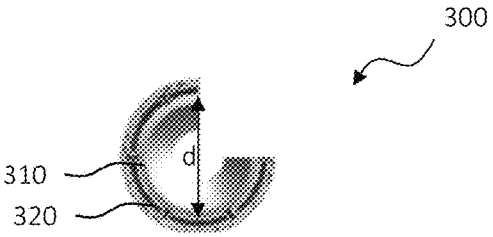
FIGS. 3A through 5B illustrate various different views of an anchor designed, manufactured and operated according to one or more embodiments of the disclosure at different operational states.
Figure 3A:
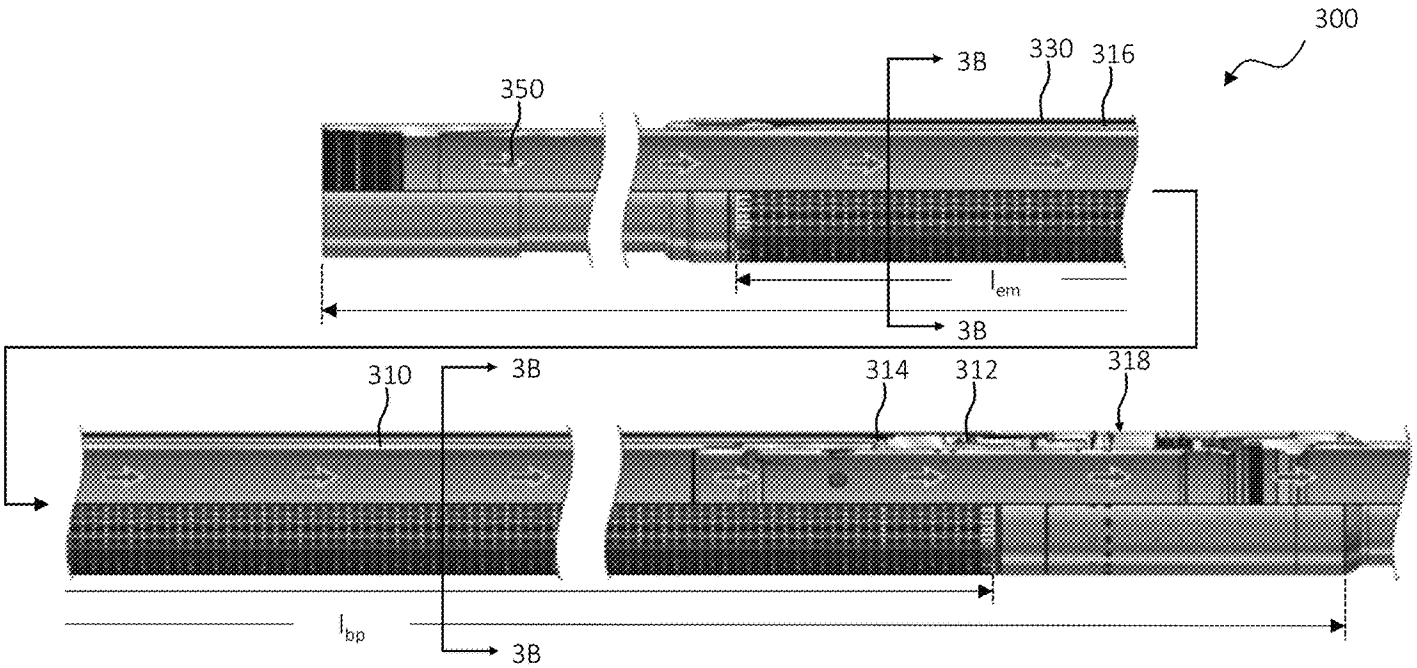
Figure 4B:
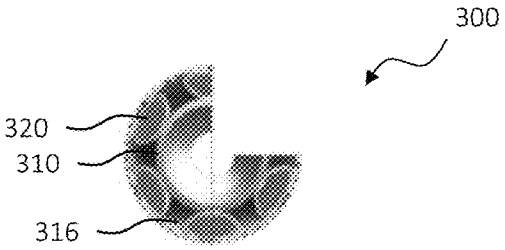
Figure 4A:
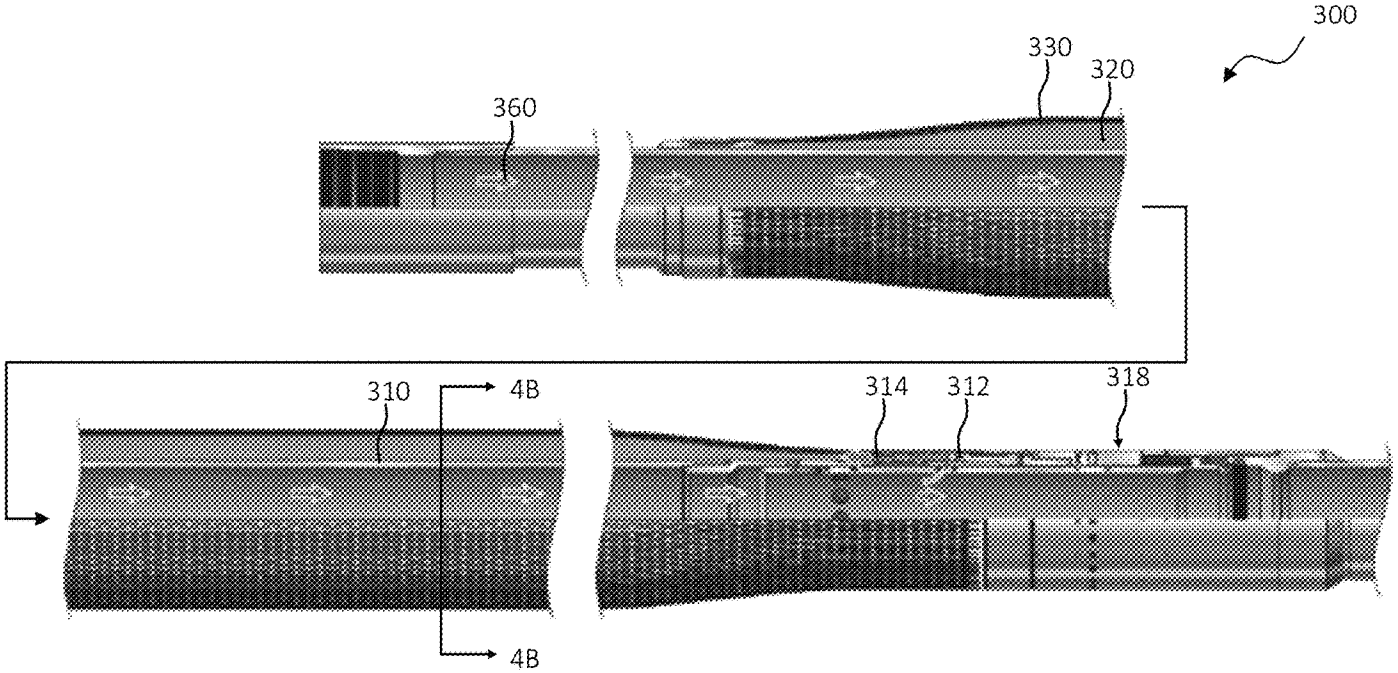
Figure 5B:
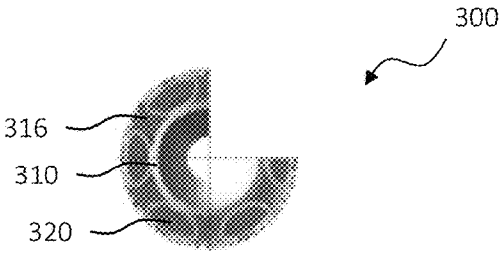

Turning to FIGS. 3A through 5B, illustrated are various different views of an anchor 300 designed, manufactured and operated according to one or more embodiments of the disclosure at different operational states. FIGS. 3A and 3B illustrate a partial sectional view and a cross-sectional view, respectively, of the anchor 300 at a run-in hole state, FIGS. 4A and 4B illustrate a partial sectional view and a cross-sectional view, respectively, of the anchor 300 when a first plurality of opening are in fluid communication with the two or more hydraulic activation chambers, and FIGS. 5A and 5B illustrate a partial sectional view and a cross-sectional view, respectively, of the anchor 300 when a second plurality of opening are in fluid communication with an annulus surrounding the base pipe.

The anchor 300 illustrated in FIGS. 3A through 5B initially includes a base pipe 310, and two or more hydraulic activation chambers 320 (e.g., at least four hydraulic activation chambers in one embodiment) disposed radially about the base pipe 310, the two or more hydraulic activation chambers 320 configured to move from a first collapsed state (e.g., as shown in FIGS. 3A and 3B) to a second activated state (e.g., as shown in FIGS. 4A through 5B) to engage with a wall of a wellbore and laterally and rotationally fix a downhole tool coupled to the base pipe 310 within the wellbore. In the illustrated embodiment, the base pipe 310 has a length ($l_{bp}$) at least 10 times a diameter (d) of the base pipe 310, and the two or more hydraulic activation chambers extending along at least a portion of the length ($l_{bp}$). In yet another embodiment, the length ($l_{bp}$) of the base pipe 310 is at least 2 meters long and a length ($l_{ac}$) of the two or more hydraulic activation chambers 320 is at least 1.5 meters long. In at least one other embodiment, the length ($l_{bp}$) of the base pipe 310 is at least 4 meters long and the length ($l_{ac}$) of the two or more hydraulic activation chambers 320 is at least 3 meters long. In yet another embodiment, the length ($l_{bp}$) of the base pipe 310 is at least 10 meters long and the length ($l_{ac}$) of the two or more hydraulic activation chambers 320 is at least 7.5 meters long.

The base pipe 310, in at least one embodiment, includes a first plurality of openings 312, the first plurality of openings 312 configured to provide fluid communication between the base pipe 310 and the two or more hydraulic activation chambers 320 to move the two or more hydraulic activation chambers 320 from the first collapsed state (e.g., shown in FIGS. 3A and 3B) to the second activated state (e.g., shown in FIGS. 4A through h5B). The base pipe, in at least one other embodiment, includes a second plurality of openings 314, the second plurality of openings 314 configured to provide fluid communication between the base pipe 310 and an annulus 316 surrounding the base pipe 310 when the two or more hydraulic activation chambers 320 are in the second activated state.

In the illustrated embodiment of FIGS. 3A through 5B, the anchor 300 additionally includes a valve 318 coupled to the base pipe 310. The valve 318, in one or more embodiments, includes a first setting that closes fluid communication to the first plurality of openings 312 and the second plurality of openings 314, a second setting that only opens fluid communication to the first plurality of openings 312, and a third setting that only opens fluid communication to the second plurality of openings 314. While the valve 318 has been illustrated as a sliding sleeve valve in FIGS. 3A through 5B, other types of valves may be used and remain within the scope of the disclosure.

With reference to FIGS. 3A and 3B, the valve 318 is at the first setting, wherein fluid communication to the first plurality of openings 312 and the second plurality of openings 314 is closed, and thus fluid 350 may bypass the anchor 300. Accordingly, the two or more hydraulic activation chambers 320 remain in the first collapsed state.

With reference to FIGS. 4A and 4B, the valve 318 is at the second setting, wherein fluid communication is only open to the first plurality of openings 312. Accordingly, fluid 360 may enter the two or more hydraulic activation chambers 320 and move them to the second activated state. In at least one embodiment, the fluid 360 plastically deforms the two or more hydraulic activation chambers 320, such that they may remain in the second activated state regardless of the setting of the valve 318. In yet another embodiment, the valve 318 moves from the second state to either of the first state or the third state while the two or more hydraulic activation chambers 320 are under pressure. Accordingly, the pressurized fluid 360 may be trapped within the two or more hydraulic activation chambers 320, thereby keeping them in the second activated state.

Figure 5A:
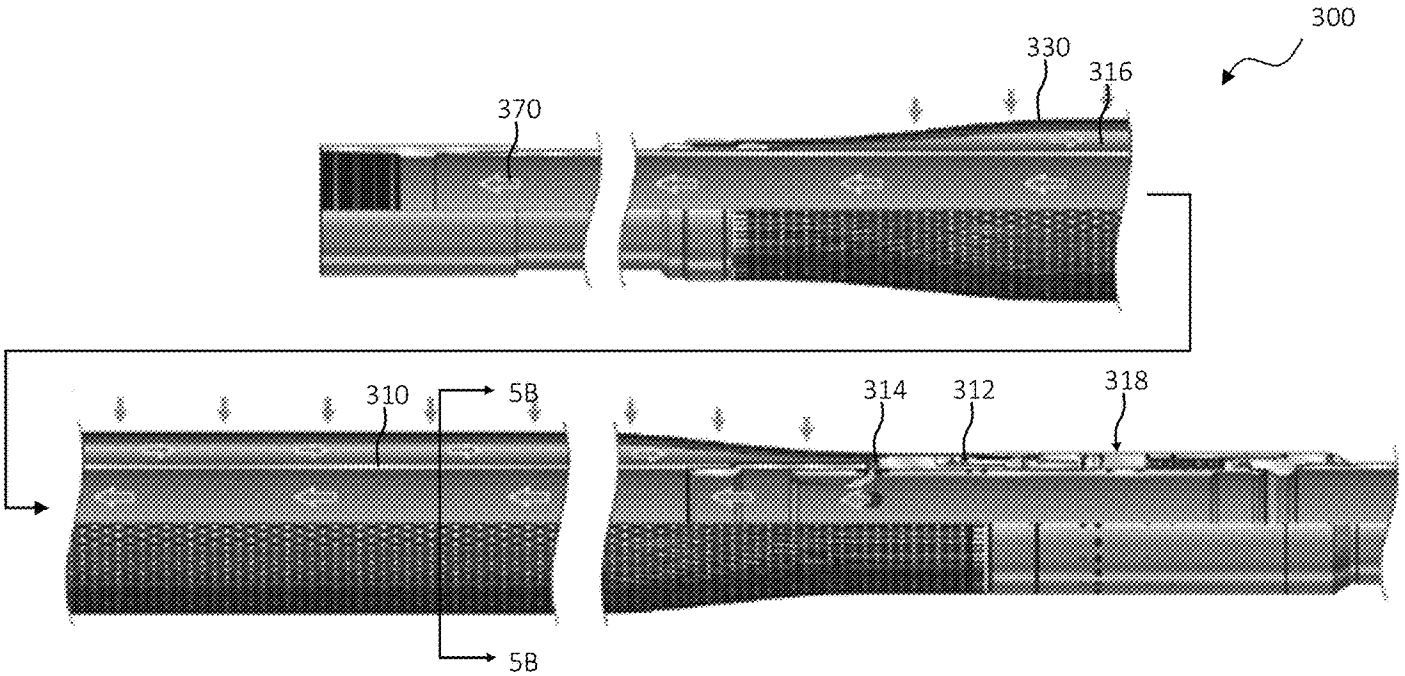

With reference to FIGS. 5A and 5B, the valve 318 is at the third setting, wherein fluid communication is only open to the second plurality of openings 314. Accordingly, fluid 370 may move between the base pipe 310 and the annulus 316 surrounding the base pipe 310 when the two or more hydraulic activation chambers 320 are in the second activated state.

Turning now to FIGS. 6 through 18, illustrated are cross-sectional views of a multilateral well 600 designed, manufactured and operated according to one or more embodiments of the disclosure. The multilateral well 600 illustrated in the embodiment of FIG. 6 includes a larger uphole casing section 610 and a smaller downhole casing section 620. The multilateral well 600 additionally includes an open hole main wellbore 630. For example, in the illustrated embodiment of FIG. 6, a drilling assembly 640 including a drill bit 650 is being deployed within the multilateral well 600 to form the main wellbore 630.

Figure 6:
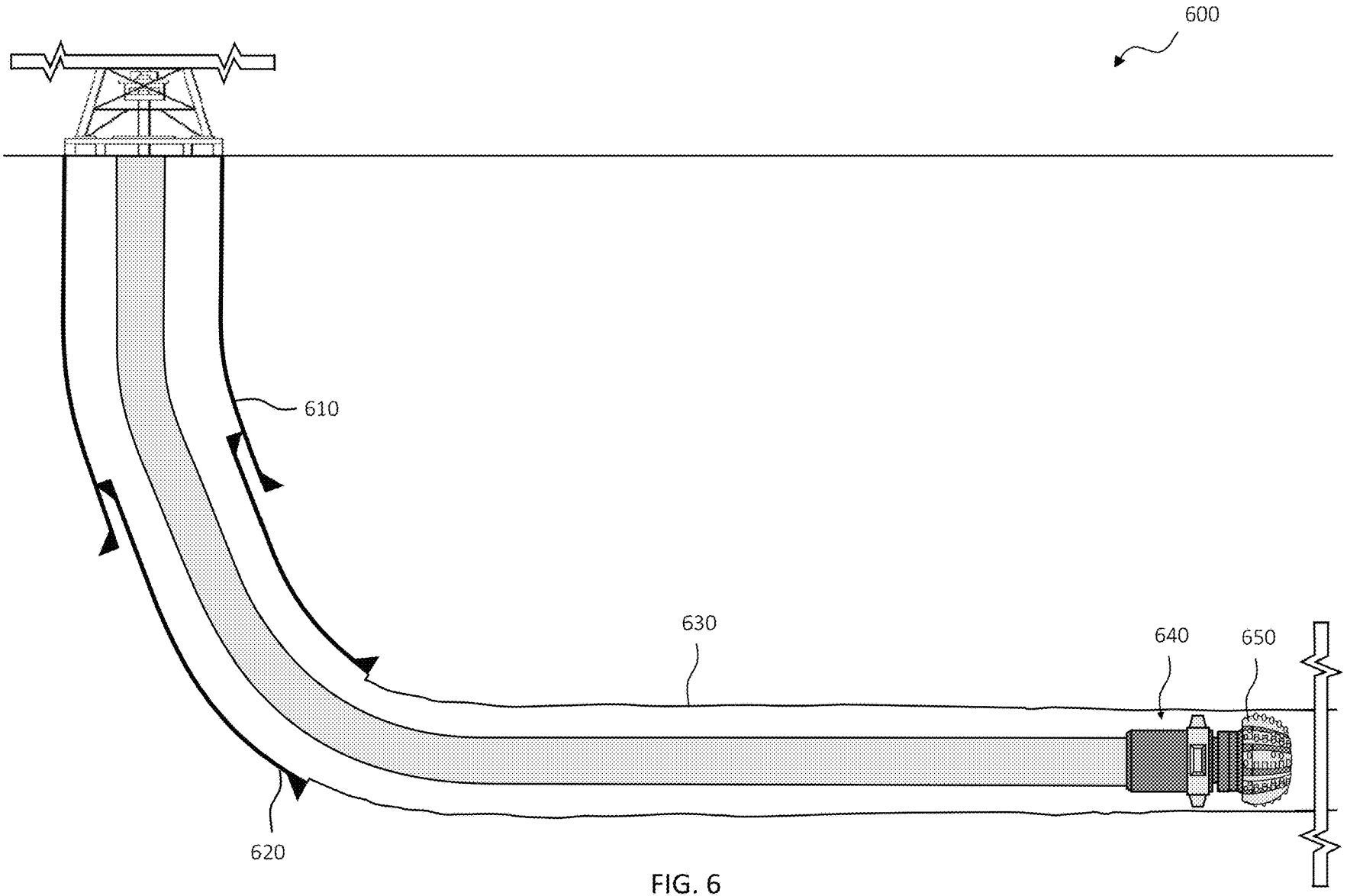
FIGS. 6 through 18 illustrate cross-sectional views of a multilateral well designed, manufactured and operated according to one or more embodiments of the disclosure.
Figure 7:
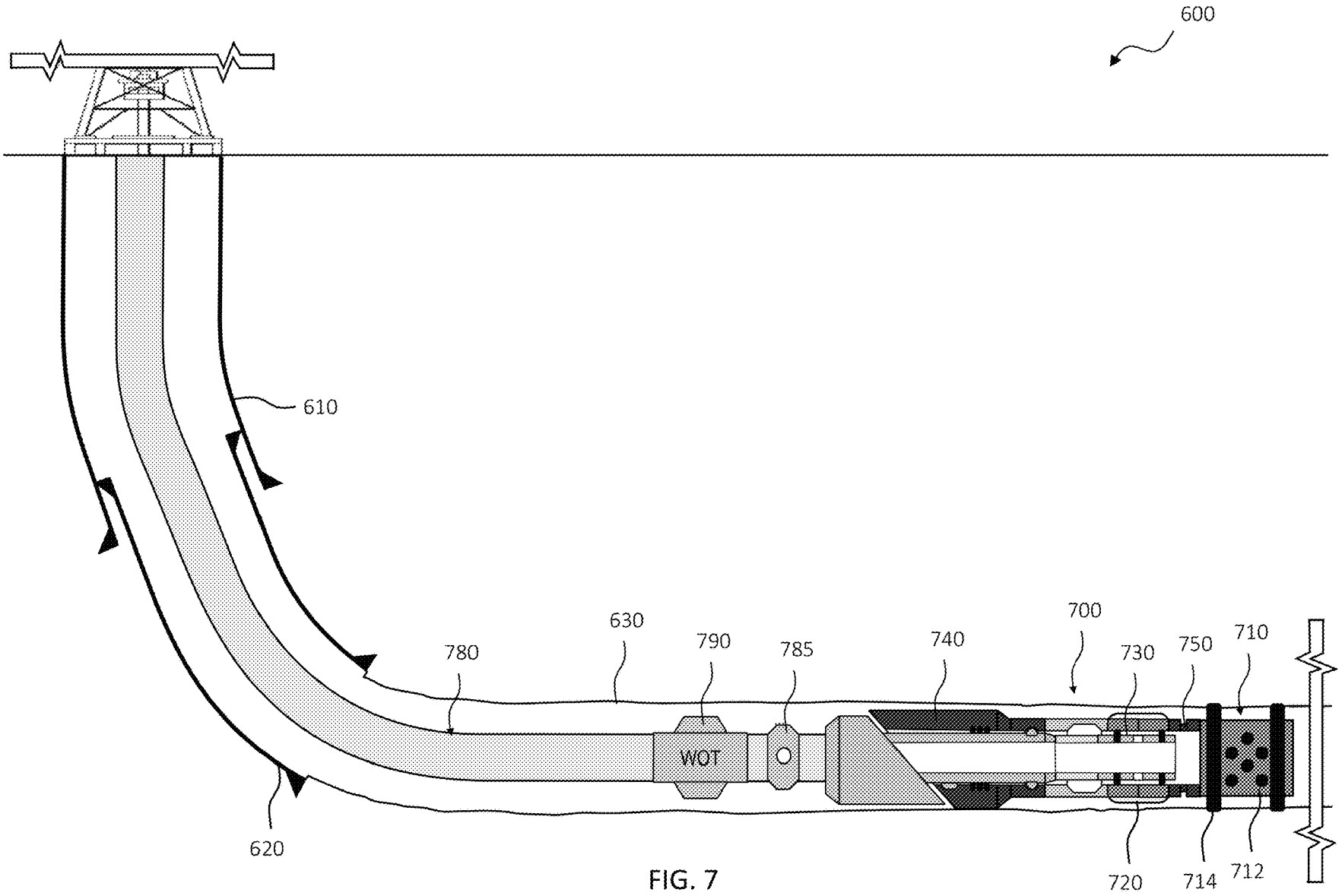

Turning to FIG. 7, illustrated is the multilateral well 600 of FIG. 6 after positioning a downhole tool 700 within the main wellbore 630 using a downhole conveyance 780. The downhole tool 700, in one or more embodiments, includes a main bore completion 710 (e.g., including a sand screen 712 and one or more main bore completion sealing elements 714). The downhole tool 700 additionally includes an anchor 720. The anchor 720, in one or more embodiments, may be similar to one or more of the anchors discussed above with regard to FIGS. 1 through 5B. Accordingly, the anchor 720 may include a base pipe, and two or more hydraulic activation chambers disposed radially about the base pipe, the two or more hydraulic activation chambers configured to move from a first collapsed state to a second activated state to engage with a wall of a wellbore (e.g., main wellbore 630) and laterally and rotationally fix the downhole tool 700 therein. In the illustrated embodiment, the anchor 720 is coupled uphole of the main bore completion 710, and is in the radially retracted state.

The downhole tool 700 may additionally include an anchor setting tool 730. The anchor setting tool 730, in one or more embodiments, may include a check valve, shearable ball-seat, flapper valve, rupture disc or similar device for setting the anchor 720. The downhole tool may additionally include a whipstock 740 (e.g., an open hole whipstock with pre-installed running tool) having a through bore extending entirely therethrough. The whipstock 740, as those skilled in the art appreciate, may be used (e.g., along with a drill bit) to drill a lateral wellbore off of the main wellbore 630. In at least one embodiment, the downhole tool 700 additionally includes a swivel 750. The swivel 750, in one or more embodiments, allows for the orientation of the whipstock 740 without turning the entire main bore completion 710.

The downhole conveyance 780 illustrated in FIG. 7 includes a circulation sub 785, as well as a work-string orientation tool (WOT) or measuring while drilling tool (MWD) 790. The WOT or MWD 790 may be used to enable a tool face reading of the whipstock 740 for orientation purposes.

Figure 8:
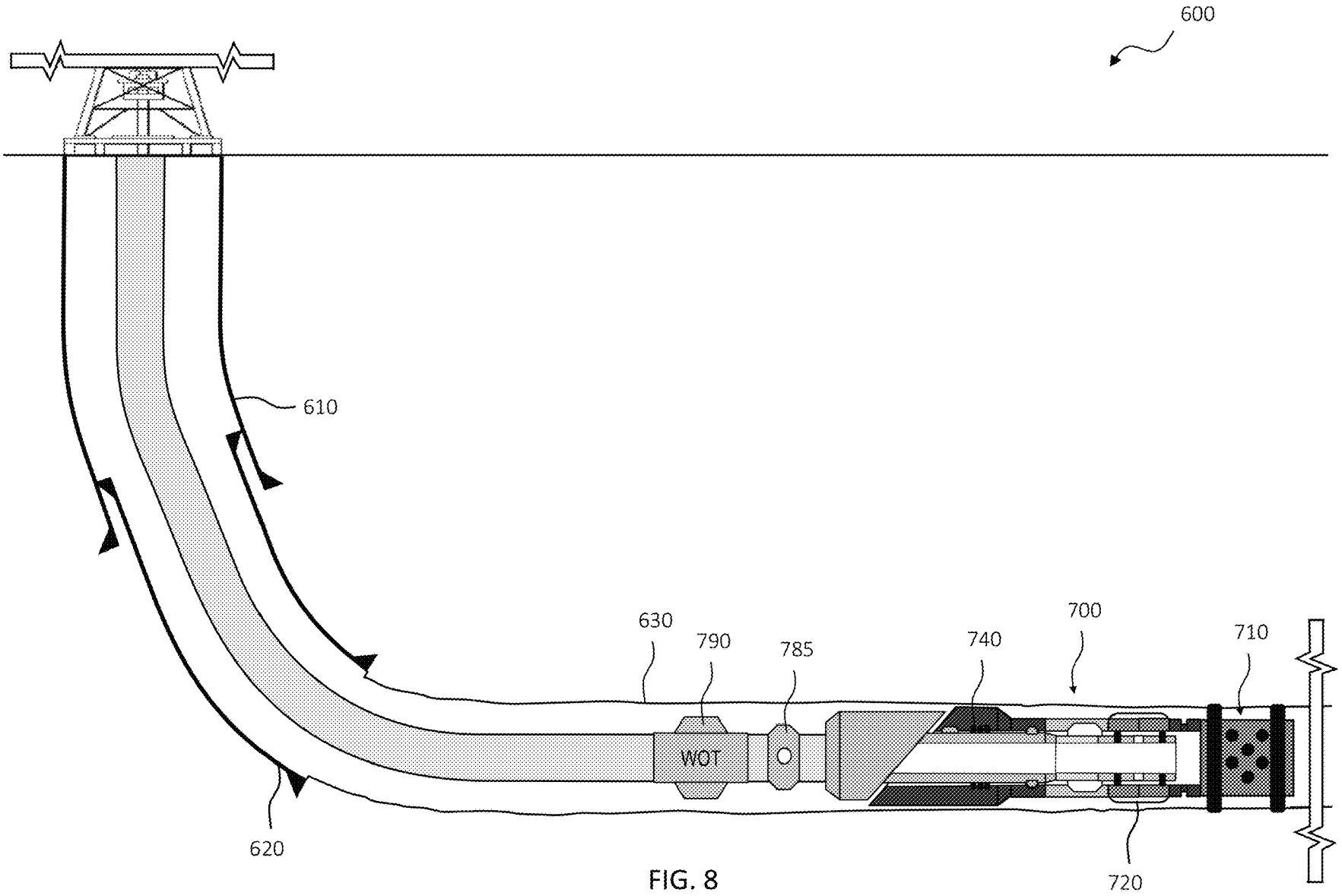
Figure 9:
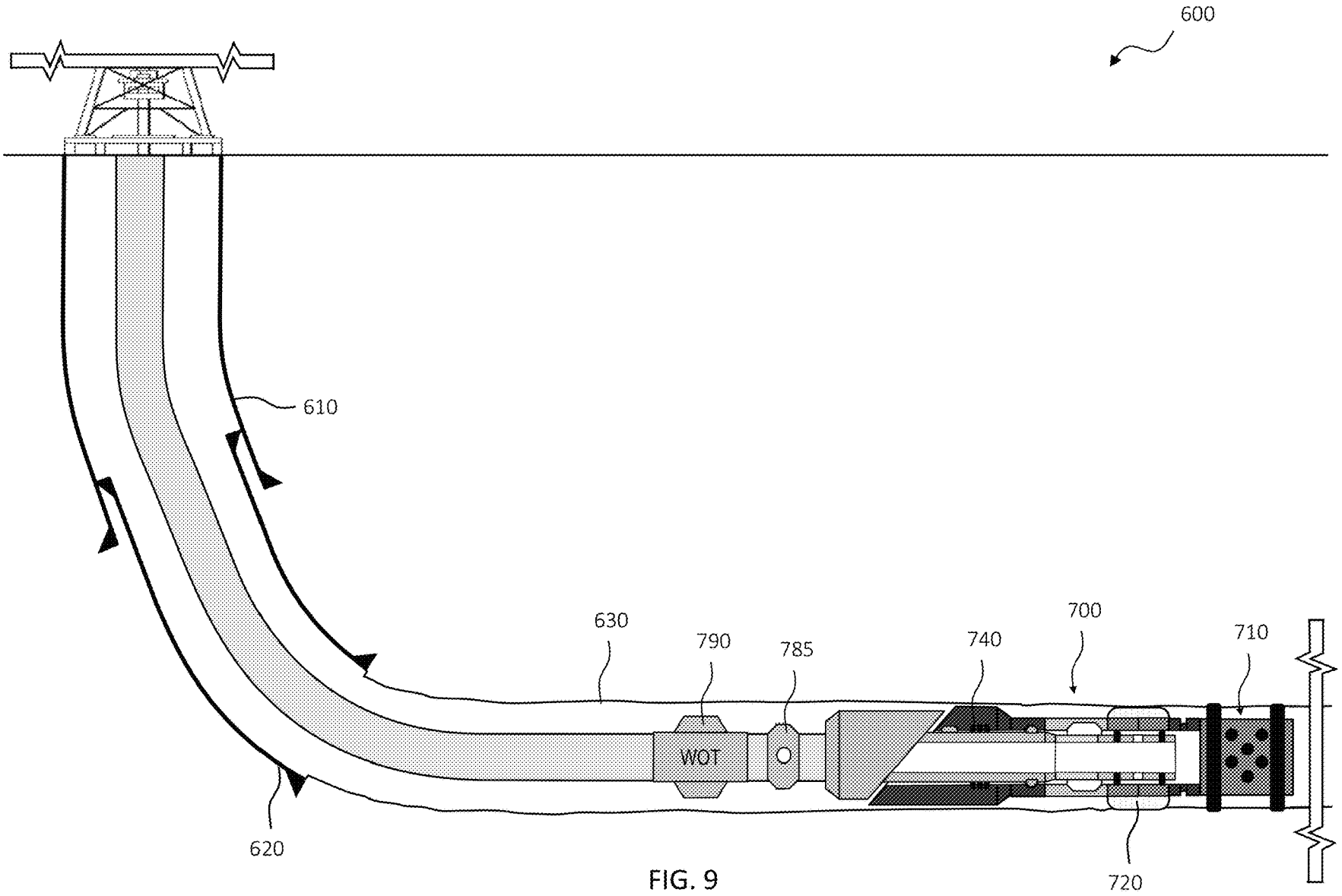

Turning to FIG. 8, illustrated is the multilateral well 600 of FIG. 7 after orienting the whipstock 740. For example, when at depth, fluid could flow through the circulation sub 785 to obtain a whipstock 740 tool face orientation. In at least one embodiment, such as that shown, the whipstock 740 is oriented to a high side of the main wellbore 630. Nevertheless, other orientations are within the scope of the disclosure Turning to FIG. 9, illustrated is the multilateral well 600 of FIG. 8 after activating/deploying the anchor 720. The anchor 720 may be activated/deployed by first setting its valve to its second position, and then pressuring up on the two or more hydraulic activation chambers to move the two or more hydraulic activation chambers from their first collapsed state to their second activated state. In at least one embodiment, a pre-determined activation pressure is maintained for a period of time to fully activate the anchor 720.

In at least one embodiment, an optional push/pull test may be performed on the anchor 720 to confirm that it is fully activated. Thereafter, pressure may be applied to the downhole conveyance 780 to release it from the whipstock 740. Thereafter, the downhole conveyance 780 may be pulled out of the main wellbore 630.

Figure 10:
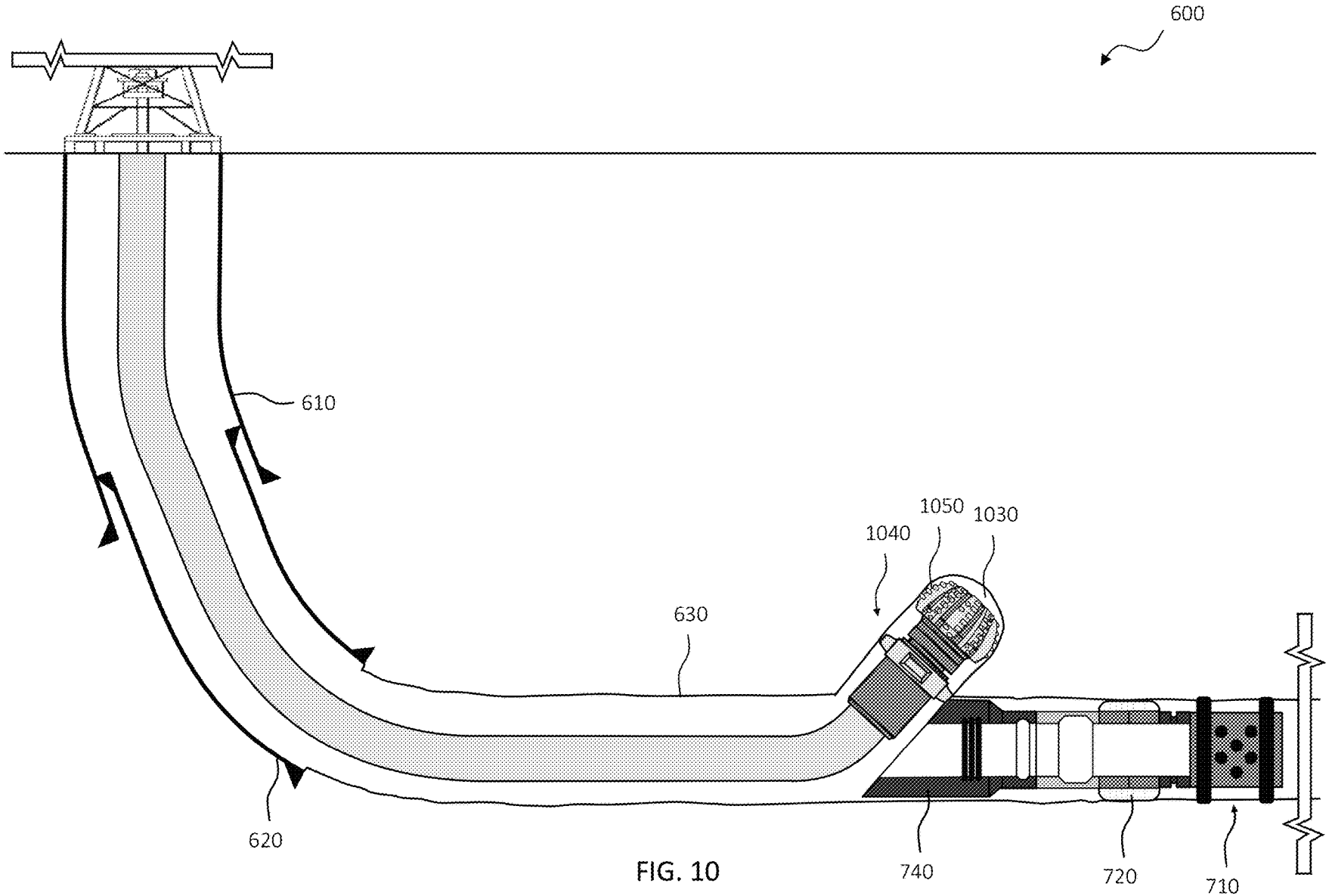

Turning to FIG. 10, illustrated is the multilateral well 600 of FIG. 9 after deploying a drilling assembly 1040 including a drill bit 1050 within the multilateral well 600 to form a lateral rat hole 1030. The lateral rat hole 1030 is formed, in at least one embodiment, by deflecting the drill bit 1050 off of the whipstock 740. The lateral rat hole 1030, in at least one embodiment, is a pocket run in the formation to ensure successful sidetrack/departure in an open hole scenario.

Figure 11:
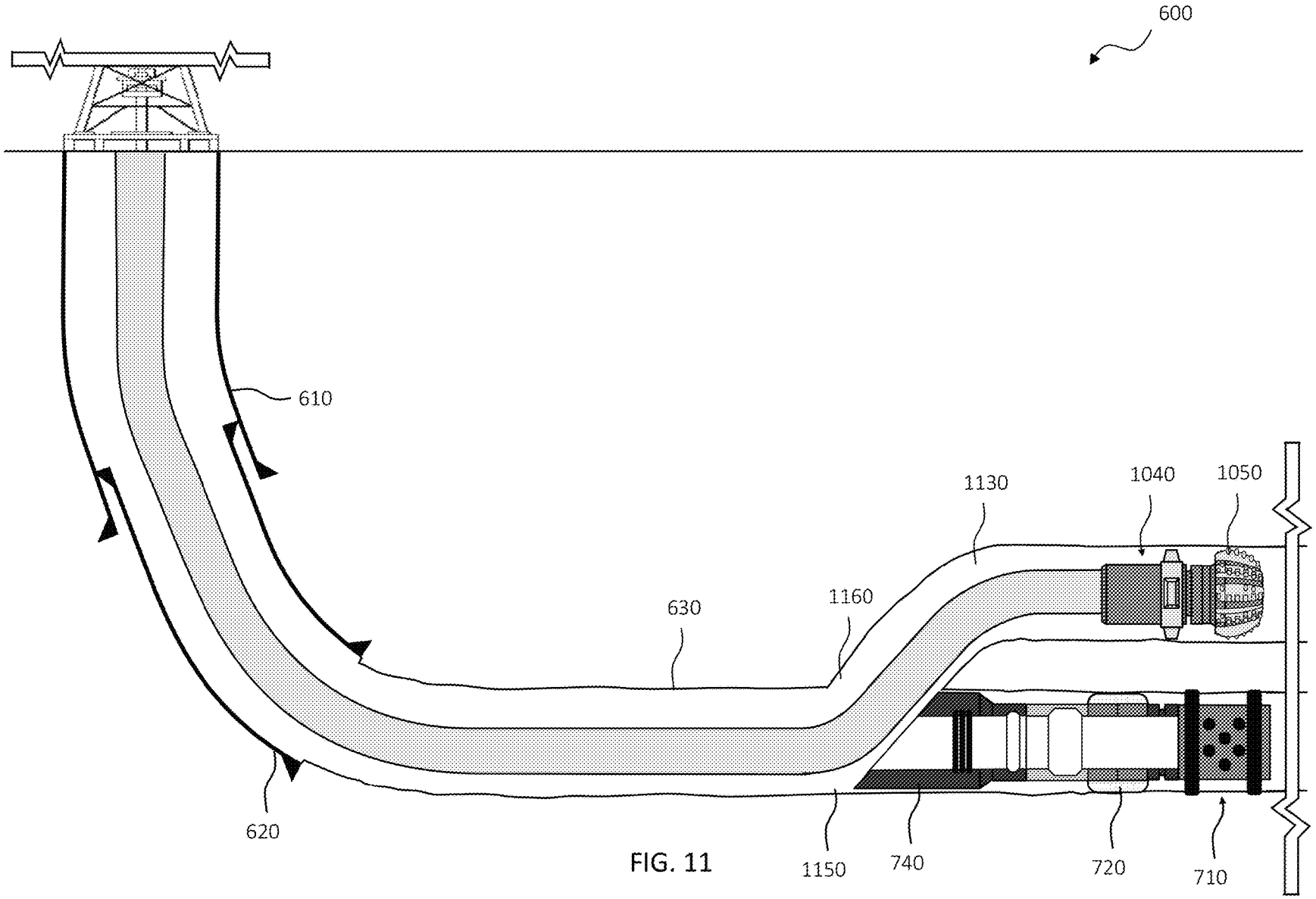

Turning to FIG. 11, illustrated is the multilateral well 600 of FIG. 10 after deploying the drilling assembly 1040 including the drill bit 1050 (or an alternative drilling assembly including an alternative drill bit) to complete a lateral wellbore 1130 within the multilateral well 600. The lateral wellbore 1130 may be drilled to depth as planned. In one or more embodiments, the lateral wellbore 1130 may extend up to 10,000 meters from the main wellbore 630. As shown in FIG. 11, the main wellbore 630 includes a main wellbore open hole section 1150, and the lateral wellbore 1130 includes a lateral wellbore open hole section 1160.

Figure 12:
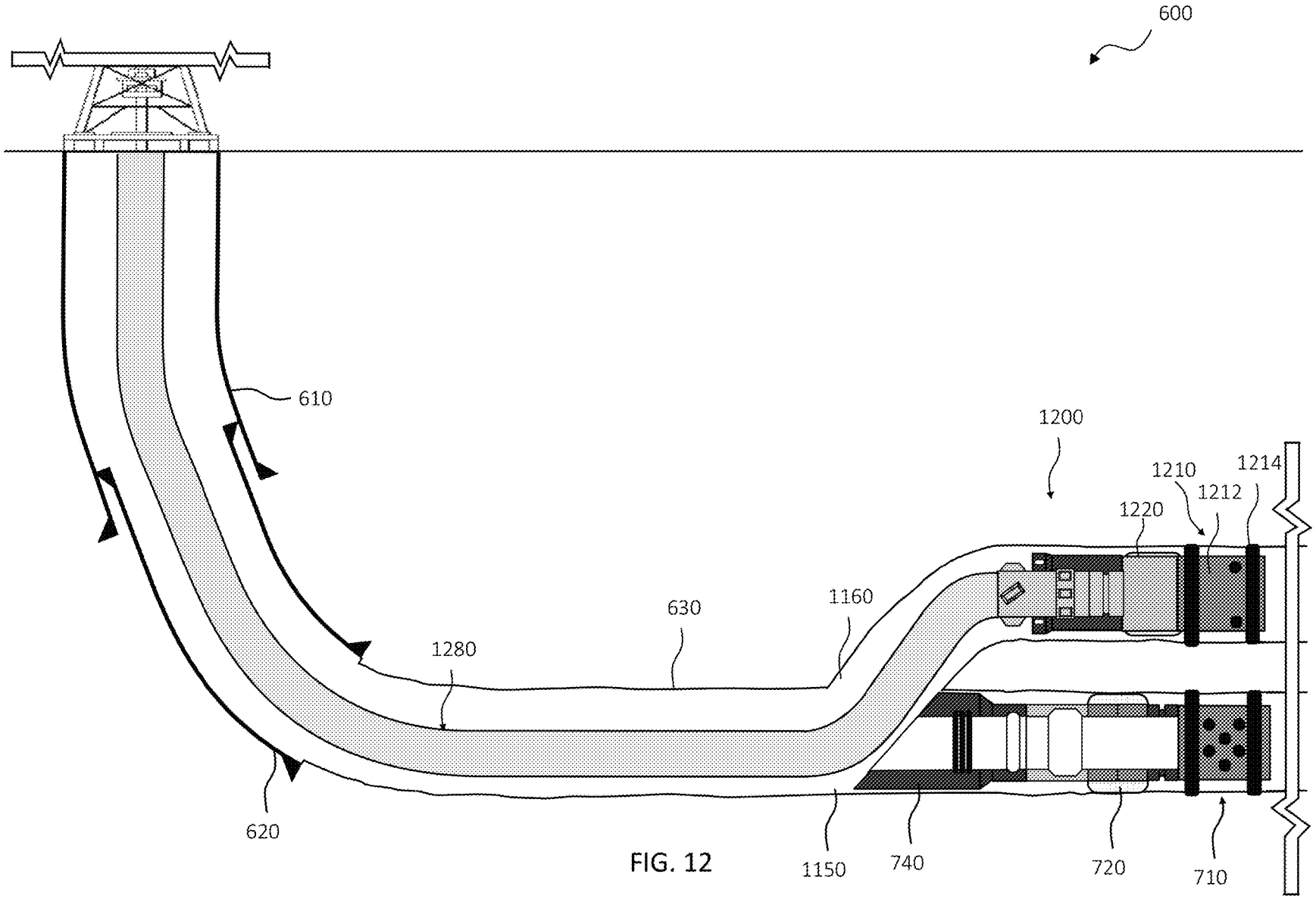

Turning to FIG. 12, illustrated is the multilateral well 600 of FIG. 11 after positioning a downhole tool 1200 within the lateral wellbore 1130 using a downhole conveyance 1280. The downhole tool 1200, in one or more embodiments, includes a lateral bore completion 1210 (e.g., including a sand screen 1212 and one or more main bore completion sealing elements 1214). The downhole tool 1200 may additionally include an anchor 1220. The anchor 1220, in one or more embodiments, may be similar to one or more of the anchors discussed above with regard to FIGS. 1 through 5B. Accordingly, the anchor 1220 may include a base pipe, and two or more hydraulic activation chambers disposed radially about the base pipe, the two or more hydraulic activation chambers configured to move from a first collapsed state to a second activated state to engage with a wall of a wellbore (e.g., lateral wellbore 1130) and laterally and rotationally fix the downhole tool 1200 therein. In the illustrated embodiment, the anchor 1220 is coupled uphole of the lateral bore completion 1210, and is in the radially retracted state.

Figure 13:
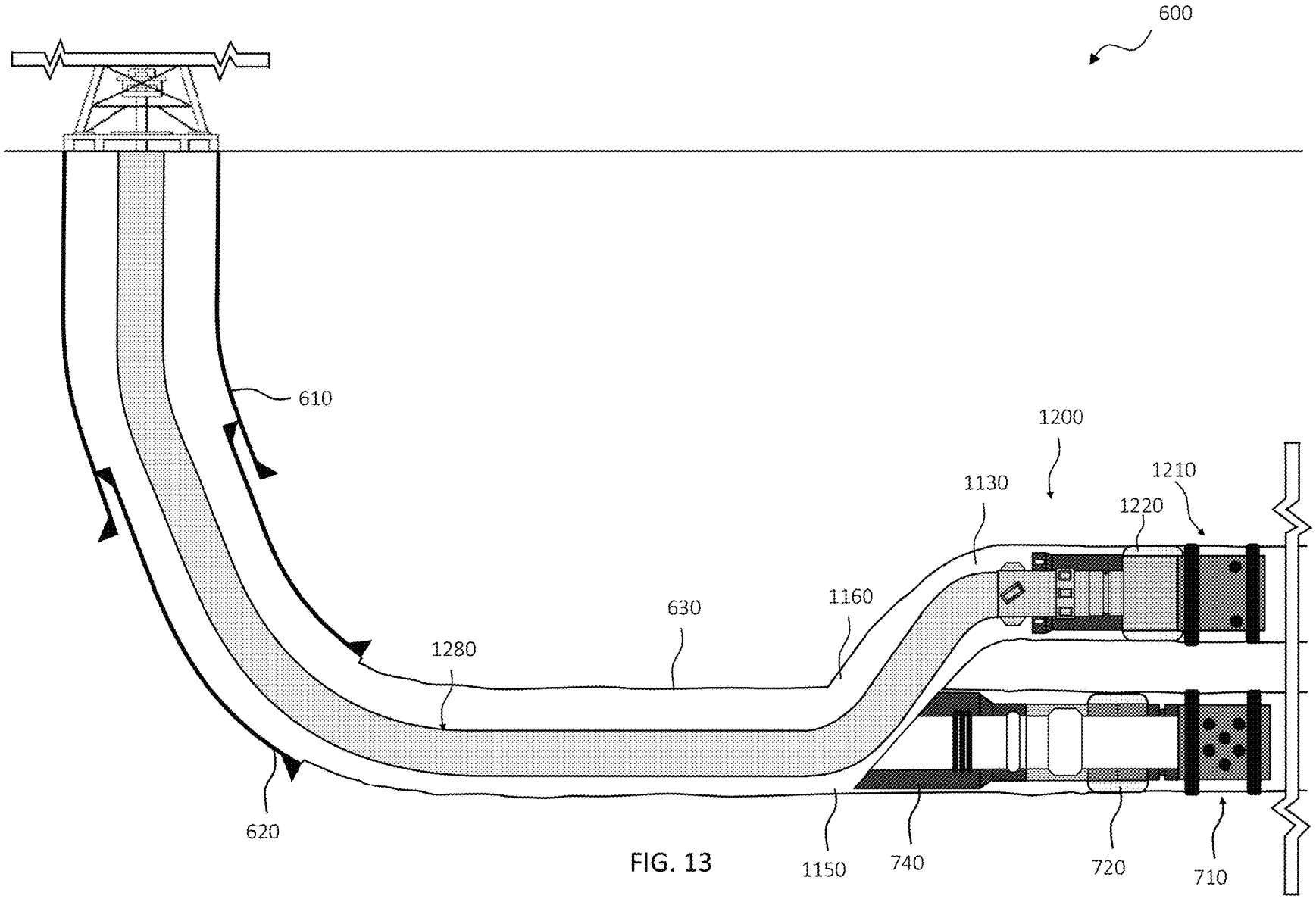

Turning to FIG. 13, illustrated is the multilateral well 600 of FIG. 12 after activating/deploying the anchor 1220. The anchor 1220 may be activated/deployed by first setting its valve to its second position, and then pressuring up on the two or more hydraulic activation chambers to move the two or more hydraulic activation chambers from their first collapsed state to their second activated state. In at least one embodiment, a pre-determined activation pressure is maintained for a period of time to fully activate the anchor 1220.

Figure 14:
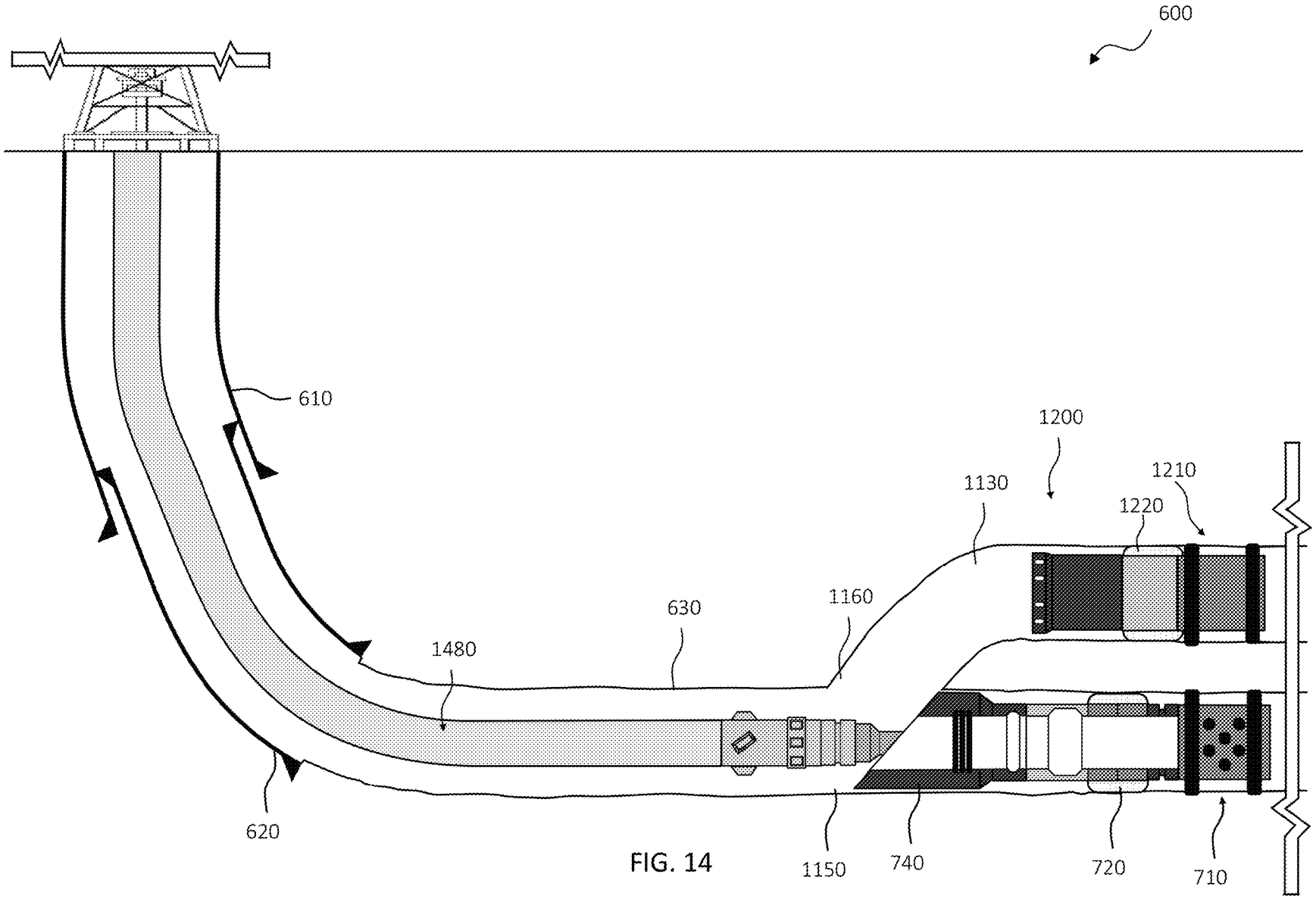

Turning to FIG. 14, illustrated is the multilateral well 600 of FIG. 13 after employing a downhole conveyance 1480 to wash down and clean out the whipstock 740 bore. In at least one embodiment, the downhole conveyance 1480 is the same downhole conveyance as used to position the downhole tool 1200 within the lateral wellbore 1130. In other embodiments, however, they are different tools.

Figure 15:
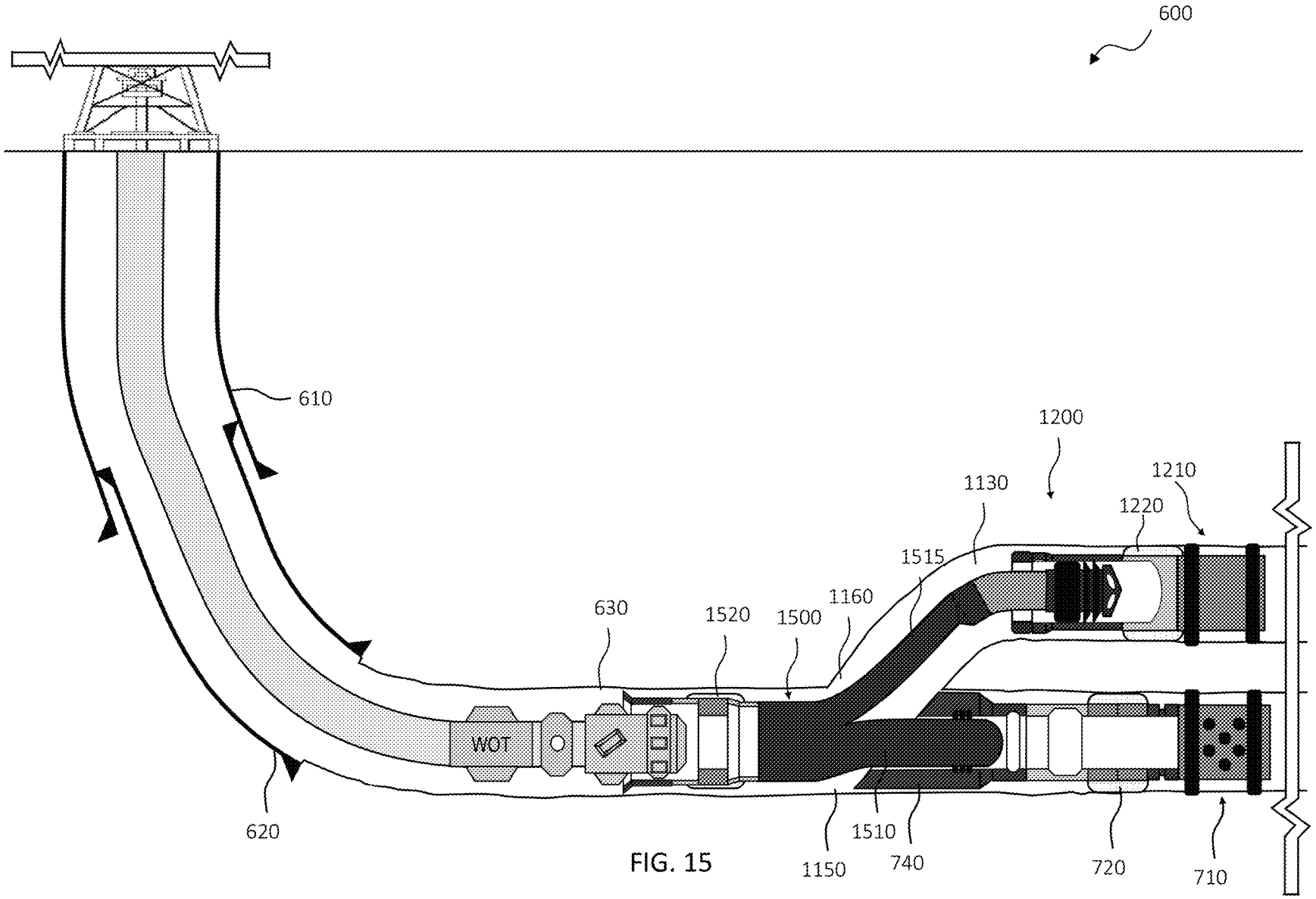

Turning to FIG. 15, illustrated is the multilateral well 600 of FIG. 14 after positioning a multilateral junction 1500 at an intersection between the main wellbore open hole section 1150 and the lateral wellbore open hole section 1160. The multilateral junction 1500, in the illustrated embodiment, includes a main bore leg 1510 for engaging with the main bore completion 710 (e.g., by stabbing into the whipstock 740 in one embodiment) and a lateral bore leg 1515 for engaging with the lateral bore completion 1210.

Coupled uphole of the multilateral junction 1500, in one or more embodiments, is another anchor 1520. The anchor 1520, in one or more embodiments, may be similar to one or more of the anchors discussed above with regard to FIGS. 1 through 5B. Accordingly, the anchor 1520 may include a base pipe, and two or more hydraulic activation chambers disposed radially about the base pipe, the two or more hydraulic activation chambers configured to move from a first collapsed state to a second activated state to engage with a wall of a wellbore (e.g., main wellbore 630) and laterally and rotationally fix the multilateral junction 1500 therein. In the illustrated embodiment, the anchor 1520 is coupled uphole of the multilateral junction 1500, and is in the radially retracted state.

Figure 16:
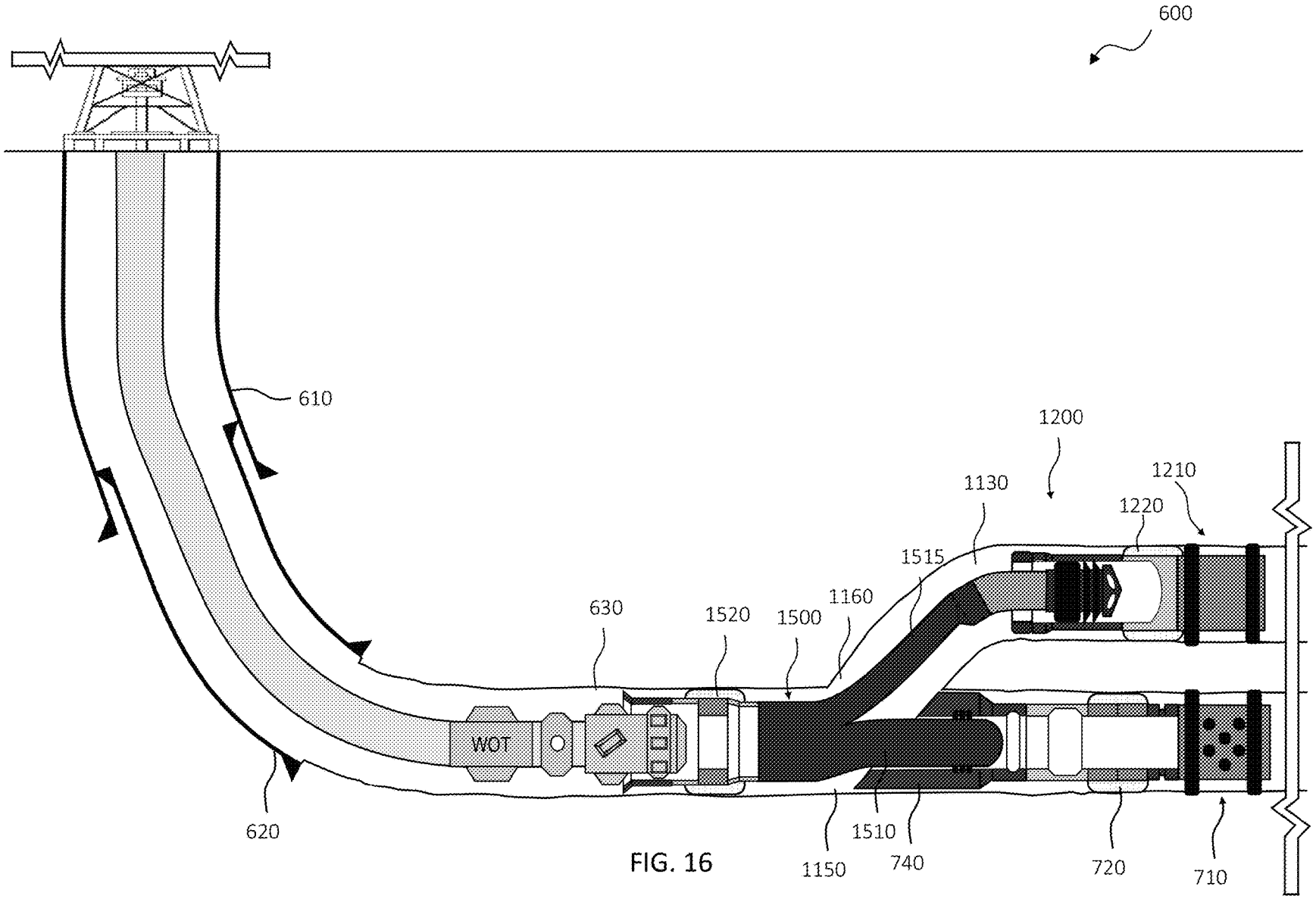

Turning to FIG. 16, illustrated is the multilateral well 600 of FIG. 15 after activating/deploying the anchor 1520. The anchor 1520 may be activated/deployed by first setting its valve to its second position, and then pressuring up on the two or more hydraulic activation chambers to move the two or more hydraulic activation chambers from their first collapsed state to their second activated state. In at least one embodiment, a pre-determined activation pressure is maintained for a period of time to fully activate the anchor 1520.

Figure 17:
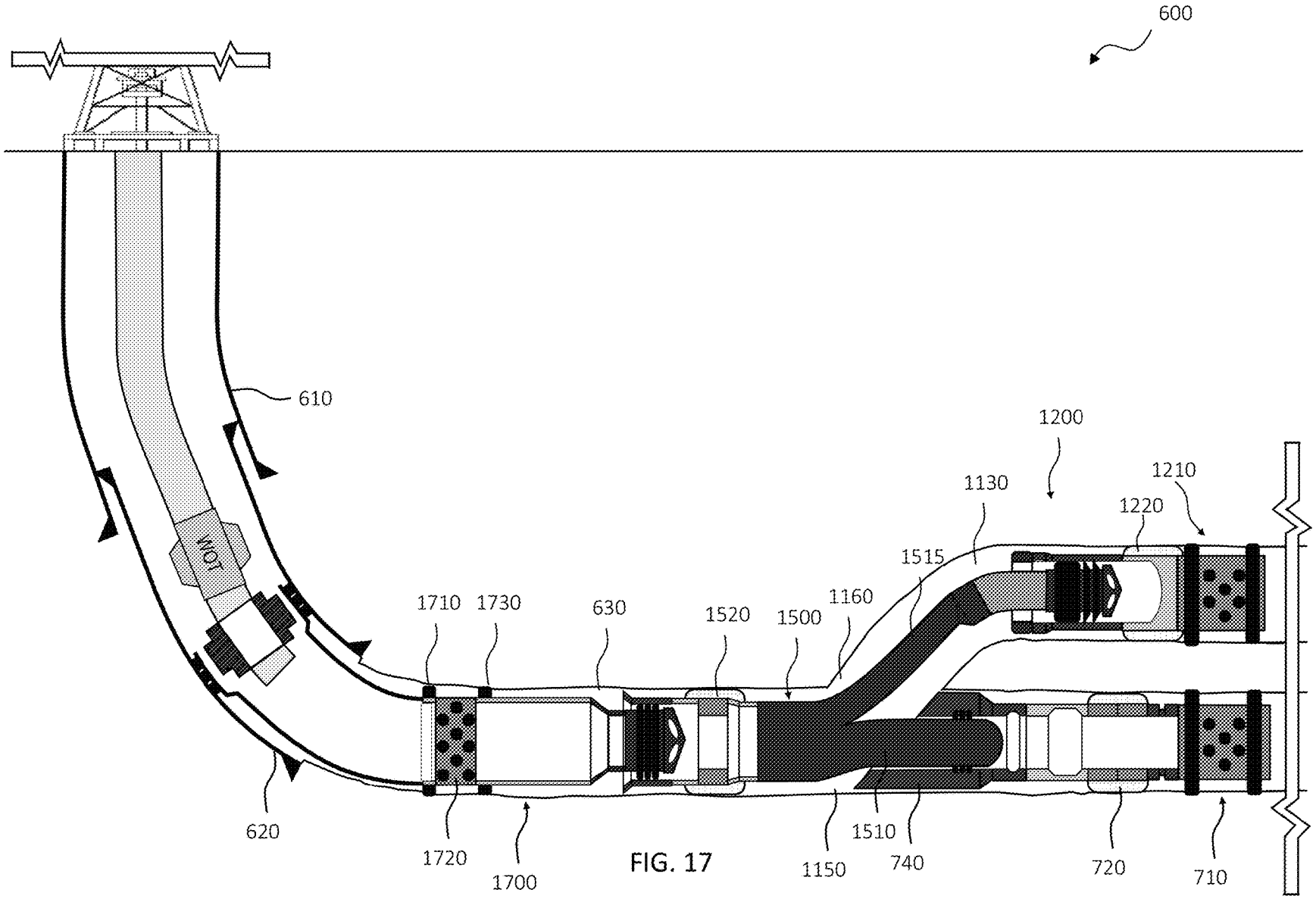

Turning to FIG. 17, illustrated is the multilateral well 600 of FIG. 16 after coupling an intermediate liner 1700 to an uphole end of the multilateral junction 1500. The intermediate liner 1700, in the illustrated embodiment, includes a first set of one or more intermediate liner sealing elements 1710, a second set of one or more intermediate liner sealing elements 1730, and main wellbore screen assembly 1720 positioned between the first set of sealing elements 1710 and the second set of sealing elements 1730. In at least one embodiment, the first set of sealing elements 1710 and the second set of sealing elements 1730 seal an annulus between the intermediate liner 1700 and the main wellbore open hole section 1150.

What results in FIG. 17, is an open-hole pressure tight TAML level 5 junction. For example, the multilateral junction 1500 is entirely positioned in the main wellbore open hole section 1150 and/or the lateral wellbore open hole section 1160. Moreover, in at least one embodiment, no cement surrounds the multilateral junction 1500, and in at least one other embodiment no cement exists in either of the main wellbore open hole section 1150 or the lateral wellbore open hole section 1160.

Furthermore, in at least one embodiment, the main bore leg 1510 of the multilateral junction 1500 forms a first pressure tight seal with the main bore completion 710, and the lateral bore leg 1515 of the multilateral junction 1500 forms a second pressure tight seal with the lateral bore completion 1210. Additionally, in at least one embodiment, a pressure tight seal exists entirely around the multilateral junction 1500, as a result of the one or more main bore completion sealing elements 714 sealing an annulus between the main bore completion 710 and the main wellbore open hole section 1150, the one or more lateral bore completion sealing elements 1214 sealing an annulus between the lateral bore completion 1210 and the lateral wellbore open hole section 1160, and the one or more intermediate liner sealing elements 1710, 1730 sealing an annulus between the intermediate liner 1700 and the main wellbore open hole section 1150.

Figure 18:
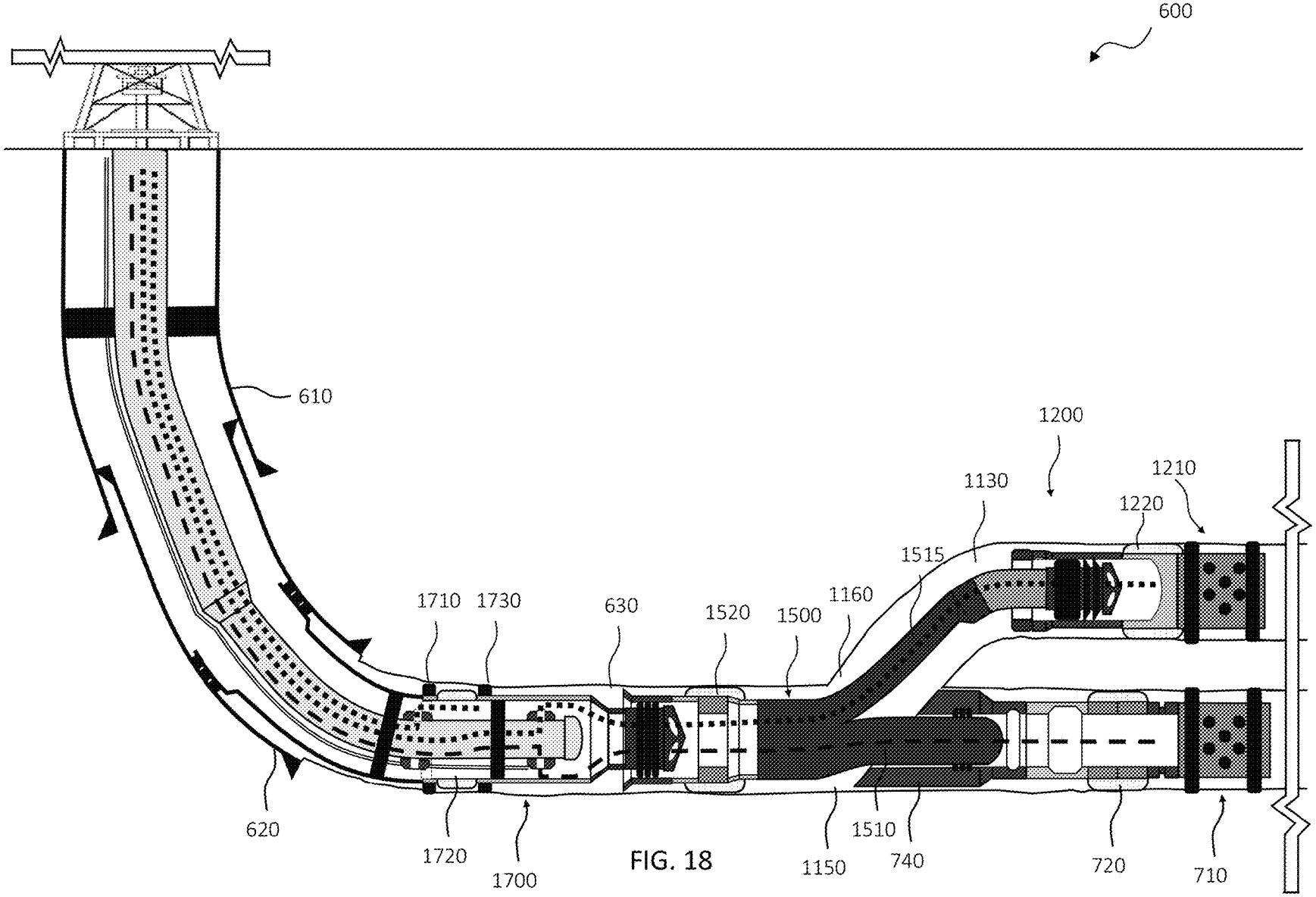

Turning to FIG. 18, illustrated is the multilateral well 600 of FIG. 17 after positioning intelligent completion components within the main wellbore 630. FIG. 18 additionally illustrates the commingled flow paths of the main bore completion 710, the lateral bore completion 1210, and the intermediate liner 1700.

Figure 19:
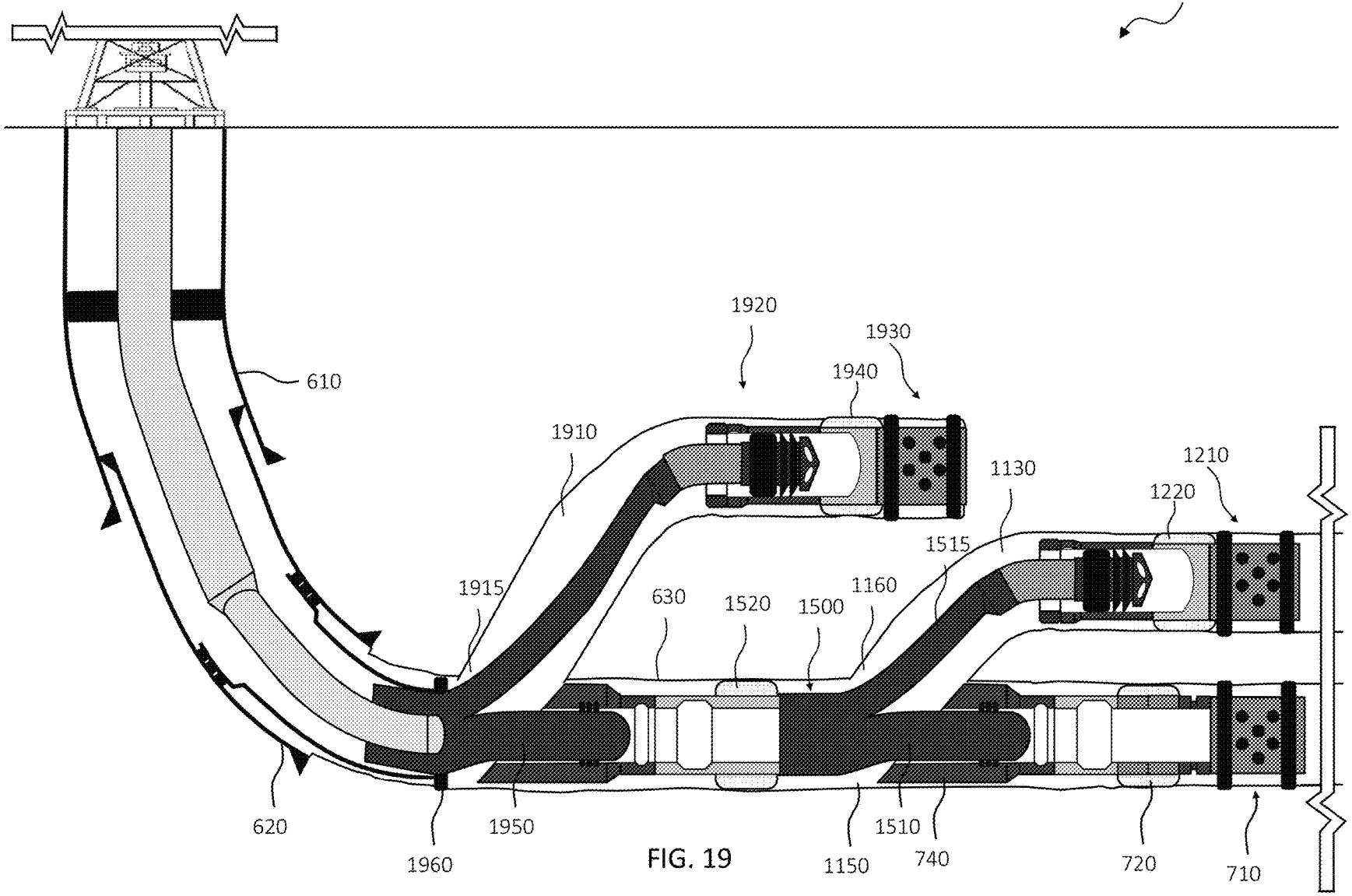
FIG. 19 illustrates a cross-sectional view of a multilateral well designed, manufactured and operated according to one or more alternative embodiments of the disclosure.

Turning now to FIG. 19, illustrated is a cross-sectional view of a multilateral well 1900 designed, manufactured and operated according to one or more alternative embodiments of the disclosure. The multilateral well 1900 is similar in many respects to the multilateral well 600 of FIGS. 6 through 18. Accordingly, like reference numbers have been used to indicate similar, if not identical, features. The multilateral well 1900 differs, for the most part, from the multilateral well 600, in that the multilateral well 1900 includes a second lateral wellbore 1910 having a second lateral wellbore open hole section 1915. The second lateral wellbore 1910, in at least one embodiment, includes a downhole tool 1920 positioned therein, the downhole tool 1920 including a second lateral bore completion 1930 (e.g., including a sand screen and one or more main bore completion sealing elements) and an anchor 1940. The anchor 1940, in one or more embodiments, may be similar to one or more of the anchors discussed above with regard to FIGS. 1 through 5B. The multilateral well 1900 additionally includes a second multilateral junction 1950 positioned proximate an intersection between the main wellbore 630 and a second lateral wellbore 1910. The multilateral well 1900 may additionally include one or more multilateral junction sealing elements 1960 sealing an annulus between the second multilateral junction 1950 and the main wellbore open hole section 1150.

Figure 20:
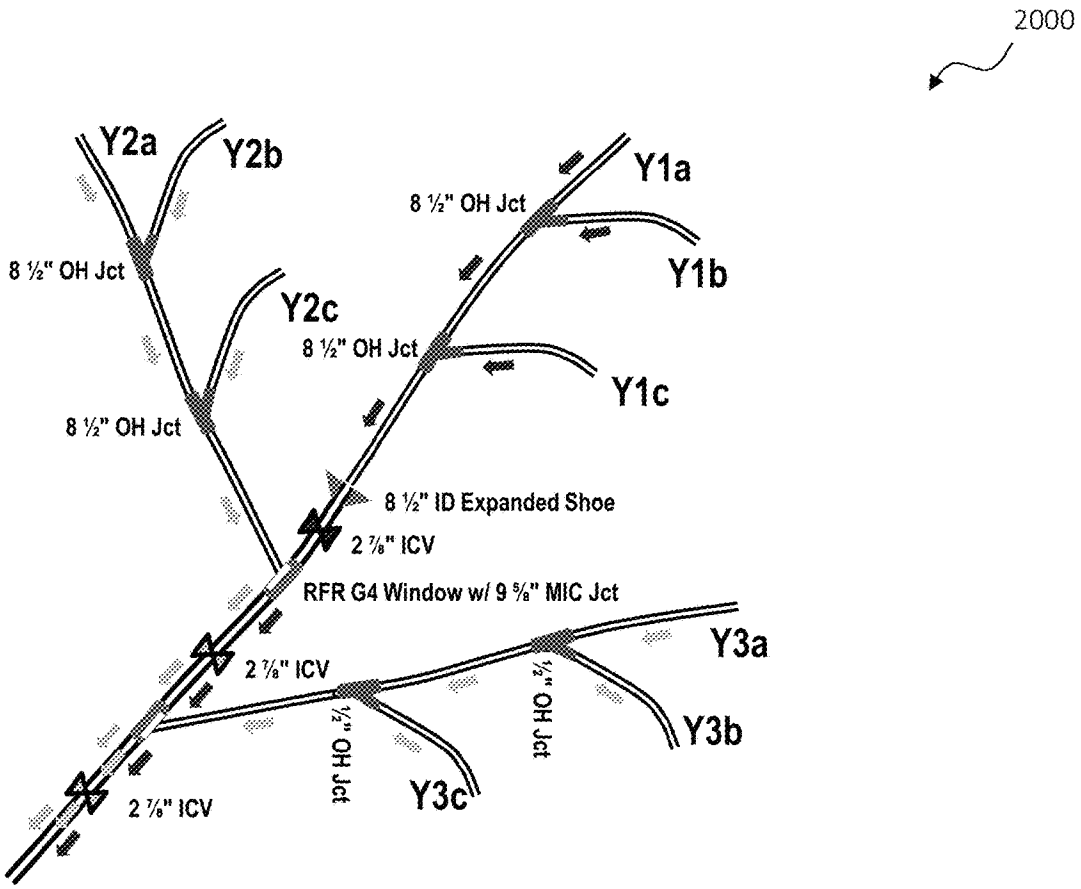
FIG. 20 illustrate a high-level reservoir architecture according to one or more embodiments of the disclosure.

Turning now to FIG. 20, illustrated is a high-level reservoir architecture 2000 according to one or more embodiments of the disclosure. The high-level reservoir architecture 2000 illustrated in FIG. 20 depicts multiple instances of open-hole pressure tight TAML level 5 junctions, for example at one or more of the twigs thereof. Furthermore, the high-level reservoir architecture illustrates that the main wellbore and the lateral wellbores may have similar open hole diameters thereof.

Aspects disclosed herein include:

A. An anchor for use with a downhole tool in a wellbore, the anchor including: 1) a base pipe; and 2) two or more hydraulic activation chambers disposed radially about the base pipe, the two or more hydraulic activation chambers configured to move from a first collapsed state to a second activated state to engage with a wall of a wellbore and laterally and rotationally fix a downhole tool coupled to the base pipe within the wellbore.

B. A well system, the well system including: 1) a wellbore; 2) a downhole tool positioned within the wellbore; and 3) an anchor coupled to the downhole tool and positioned within the wellbore, the anchor including: a) a base pipe; and b) two or more hydraulic activation chambers disposed radially about the base pipe, the two or more hydraulic activation chambers configured to move from a first collapsed state to a second activated state to engage with a wall of the wellbore and laterally and rotationally fix the downhole tool within the wellbore.

C. A method for anchoring a downhole tool within a wellbore, the method including: 1) positioning a downhole tool within a wellbore, the downhole tool having an anchor coupled thereto, the anchor including: a) a base pipe; and b) two or more hydraulic activation chambers disposed radially about the base pipe; and 2) applying fluid pressure to the two or more hydraulic activation chambers to move the two or more hydraulic activation chambers from a first collapsed state to a second activated state to engage with a wall of the wellbore and laterally and rotationally fix the downhole tool within the wellbore.

D. A well system, the well system including: 1) a main wellbore, the main wellbore having a main wellbore open hole section; 2) a lateral wellbore extending from the main wellbore, the lateral wellbore having a lateral wellbore open hole section; 3) a main bore completion located within the main wellbore and a lateral bore completion located within the lateral wellbore; and 4) a multilateral junction positioned at an intersection between the main wellbore open hole section of the main wellbore and the lateral wellbore open hole section of the lateral wellbore, the multilateral junction including a main bore leg forming a first pressure tight seal with the main bore completion and a lateral bore leg forming a second pressure tight seal with the lateral bore completion such that the main bore completion and the lateral bore completion are hydraulically isolated from one another.

E. A method for forming a well system, the method including: 1) forming a main wellbore, the main wellbore having a main wellbore open hole section; 2) forming a lateral wellbore extending from the main wellbore, the lateral wellbore having a lateral wellbore open hole section; 3) placing a main bore completion within the main wellbore and placing a lateral bore completion within the lateral wellbore; and 4) positioning a multilateral junction at an intersection between the main wellbore open hole section of the main wellbore and the lateral wellbore open hole section of the lateral wellbore, the multilateral junction including a main bore leg forming a first pressure tight seal with the main bore completion and a lateral bore leg forming a second pressure tight seal with the lateral bore completion such that the main bore completion and the lateral bore completion are hydraulically isolated from one another.

Aspects A, B, C, D and E may have one or more of the following additional elements in combination: Element 1: further including an expandable medium disposed about the two or more hydraulic activation chambers, the expandable medium configured to expand radially via the two or more hydraulic activation chambers to fix the downhole tool within the wellbore. Element 2: wherein the expandable medium is an expandable non-filter medium. Element 3: further including two or more bridging plates positioned radially about the two or more expandable chambers, wherein the two or more bridging plates are configured to extend across at least a gap between outer portions of the two or more expandable chambers when the two or more hydraulic activation chambers are in the second activated state. Element 4: further including a plurality of openings in the base pipe, the plurality of openings configured to provide fluid communication between the base pipe and the two or more hydraulic activation chambers to move the two or more hydraulic activation chambers from the first collapsed state to the second activated state. Element 5: wherein the plurality of openings are a first plurality of openings, and further including a second plurality of openings in the base pipe, the second plurality of openings configured to provide fluid communication between the base pipe and an annulus surrounding the base pipe when the two or more hydraulic activation chambers are in the second activated state. Element 6: further including a valve coupled to the base pipe, the valve having a first setting that closes fluid communication to the first plurality of openings and the second plurality of openings, a second setting that only opens fluid communication to the first plurality of openings, and a third setting that only opens fluid communication to the second plurality of openings. Element 7: further including an elastomeric element positioned about the two or more hydraulic activation chambers. Element 8: wherein the elastomeric element is an annular elastomeric element configured as an annular seal. Element 9: wherein the base pipe has a length ($l_{bp}$) at least 10 times a diameter (d) of the base pipe, and further wherein the two or more hydraulic activation chambers extend along at least a portion of the length ($l_{bp}$). Element 10: wherein the length ($l_{bp}$) of the base pipe is at least 2 meters long and a length ($l_{ac}$) of the two or more hydraulic activation chambers is at least 1.5 meters long. Element 11: wherein the length ($l_{bp}$) of the base pipe is at least 4 meters long and a length ($l_{ac}$) of the two or more hydraulic activation chambers is at least 3 meters long. Element 12: wherein the length ($l_{bp}$) of the base pipe is at least 10 meters long and a length ($l_{ac}$) of the two or more hydraulic activation chambers is at least 7.5 meters long. Element 13: wherein at least four hydraulic activation chambers are disposed radially about the base pipe. Element 14: wherein the downhole tool is a lower completion. Element 15: wherein the lower completion includes production tubing having a screen assembly. Element 16: wherein the downhole tool is coupled to a downhole end of the anchor, and further wherein the anchor is configured to laterally and rotationally fix the production tubing having the screen assembly within the wellbore. Element 17: wherein the wellbore is a main wellbore, and further including a lateral wellbore extending from the main wellbore, wherein the downhole tool forms at least a portion of a multilateral junction positioned proximate an intersection between the main wellbore and the lateral wellbore. Element 18: wherein the downhole tool is a whipstock, the anchor laterally and rotationally fixing the whipstock within the wellbore. Element 19: wherein the downhole tool forms at least a portion of a first multilateral junction, the anchor is a first anchor and the lateral wellbore is a first lateral wellbore, and further including: a second downhole tool positioned within the wellbore; and a second anchor coupled to the second downhole tool and positioned within the wellbore, the second anchor including; a second base pipe; and a second set of two or more hydraulic activation chambers disposed radially about the second base pipe, the second set of two or more hydraulic activation chambers configured to move from the first collapsed state to the second activated state to engage with the wall of the wellbore and laterally and rotationally fix the second downhole tool within the wellbore. Element 20: wherein the second downhole tool forms at least a portion of a second multilateral junction positioned proximate an intersection between the main wellbore and a second lateral wellbore. Element 21: wherein the main wellbore and the lateral wellbore have a similar open hole diameter. Element 22: wherein the whipstock includes a through bore extending entirely there through. Element 23: further including an expandable medium disposed about the two or more hydraulic activation chambers, the expandable medium configured to expand radially via the two or more hydraulic activation chambers to fix the downhole tool within the wellbore. Element 24: wherein the expandable medium is an expandable non-filter medium. Element 25: wherein the wellbore is an open hole wellbore. Element 26: further including an expandable medium disposed about the two or more hydraulic activation chambers, the expandable medium expanding radially when applying the fluid pressure to the two or more hydraulic activation chambers to fix the downhole tool within the wellbore. Element 27: wherein positioning a downhole tool within a wellbore includes positioning a lower completion including production tubing having a screen assembly within a wellbore, the applying laterally and rotationally fixing the lower completion including the production tubing having the screen assembly within the wellbore. Element 28: wherein the wellbore is a main wellbore, and further including a lateral wellbore extending from the main wellbore, wherein positioning a downhole tool within a wellbore includes positioning a downhole tool forming at least a portion of a multilateral junction proximate an intersection between the main wellbore and the lateral wellbore. Element 29: further including one or more main bore completion sealing elements sealing an annulus between the main bore completion and the main wellbore open hole section. Element 30: further including one or more lateral bore completion sealing elements sealing an annulus between the lateral bore completion and the lateral wellbore open hole section. Element 31: further including an intermediate liner coupled with an uphole end of the multilateral junction, the intermediate liner including one or more intermediate liner sealing elements sealing an annulus between the intermediate liner and the main wellbore open hole section. Element 32: wherein the one or more intermediate liner sealing elements are a first set of one or more intermediate liner sealing elements, and further including a second set of one or more intermediate liner sealing elements sealing the annulus between the intermediate liner and the main wellbore open hole section, the second set of one or more intermediate liner sealing elements laterally offset from the first set of one or more intermediate liner sealing elements. Element 33: further including a main wellbore screen assembly positioned between the first set of one or more intermediate liner sealing elements and the second sets of one or more intermediate liner sealing elements. Element 34: wherein no cement surrounds the multilateral junction. Element 35: wherein the lateral wellbore is a first lateral wellbore and the lateral bore completion is a first lateral bore completion, and further including a second lateral wellbore extending from the main wellbore, the second lateral wellbore having a second lateral wellbore open hole section and a second lateral bore completion. Element 36: wherein the multilateral junction is a first multilateral junction and the intersection is a first intersection, and further including a second multilateral junction positioned at a second intersection between the main wellbore open hole section of the main wellbore and the second lateral wellbore open hole section of the second lateral wellbore, the second multilateral junction including a second main bore leg forming a third pressure tight seal with the first multilateral junction and a fourth lateral bore leg forming a fourth pressure tight seal with the second lateral bore completion. Element 37: further including one or more multilateral junction sealing elements sealing an annulus between the second multilateral junction and the main wellbore open hole section.

Those skilled in the art to which this application relates will appreciate that other and further additions, deletions, substitutions and modifications may be made to the described embodiments.

What is claimed is:

1. A well system, comprising:

a main wellbore, the main wellbore having a main wellbore open hole section;

a lateral wellbore extending from the main wellbore, the lateral wellbore having a lateral wellbore open hole section;

a main bore completion located within the main wellbore and a lateral bore completion located within the lateral wellbore; and a multilateral junction positioned at an intersection between the main wellbore open hole section of the main wellbore and the lateral wellbore open hole section of the lateral wellbore, the multilateral junction including a main bore leg forming a first pressure tight seal with the main bore completion and a lateral bore leg forming a second pressure tight seal with the lateral bore completion such that the main bore completion and the lateral bore completion are hydraulically isolated from one another.

2. The well system as recited in claim 1, further including one or more main bore completion sealing elements sealing an annulus between the main bore completion and the main wellbore open hole section.

3. The well system as recited in claim 2, further including one or more lateral bore completion sealing elements sealing an annulus between the lateral bore completion and the lateral wellbore open hole section.

4. The well system as recited in claim 3, further including an intermediate liner coupled with an uphole end of the multilateral junction, the intermediate liner including one or more intermediate liner sealing elements sealing an annulus between the intermediate liner and the main wellbore open hole section.

5. The well system as recited in claim 4, wherein the one or more intermediate liner sealing elements are a first set of one or more intermediate liner sealing elements, and further including a second set of one or more intermediate liner sealing elements sealing the annulus between the intermediate liner and the main wellbore open hole section, the second set of one or more intermediate liner sealing elements laterally offset from the first set of one or more intermediate liner sealing elements.

6. The well system as recited in claim 5, further including a main wellbore screen assembly positioned between the first set of one or more intermediate liner sealing elements and the second sets of one or more intermediate liner sealing elements.

7. The well system as recited in claim 1, wherein no cement surrounds the multilateral junction.

8. The well system as recited in claim 1, wherein the lateral wellbore is a first lateral wellbore and the lateral bore completion is a first lateral bore completion, and further including a second lateral wellbore extending from the main wellbore, the second lateral wellbore having a second lateral wellbore open hole section and a second lateral bore completion.

9. The well system as recited in claim 8, wherein the multilateral junction is a first multilateral junction and the intersection is a first intersection, and further including a second multilateral junction positioned at a second intersection between the main wellbore open hole section of the main wellbore and the second lateral wellbore open hole section of the second lateral wellbore, the second multilateral junction including a second main bore leg forming a third pressure tight seal with the first multilateral junction and a fourth lateral bore leg forming a fourth pressure tight seal with the second lateral bore completion.

10. The well system as recited in claim 9, further including one or more multilateral junction sealing elements sealing an annulus between the second multilateral junction and the main wellbore open hole section.

11. A method for forming a well system, comprising:

forming a main wellbore, the main wellbore having a main wellbore open hole section;

forming a lateral wellbore extending from the main wellbore, the lateral wellbore having a lateral wellbore open hole section;

placing a main bore completion within the main wellbore and placing a lateral bore completion within the lateral wellbore; and positioning a multilateral junction at an intersection between the main wellbore open hole section of the main wellbore and the lateral wellbore open hole section of the lateral wellbore, the multilateral junction including a main bore leg forming a first pressure tight seal with the main bore completion and a lateral bore leg forming a second pressure tight seal with the lateral bore completion such that the main bore completion and the lateral bore completion are hydraulically isolated from one another.

12. The method as recited in claim 11, further including one or more main bore completion sealing elements sealing an annulus between the main bore completion and the main wellbore open hole section.

13. The method as recited in claim 12, further including one or more lateral bore completion sealing elements sealing an annulus between the lateral bore completion and the lateral wellbore open hole section.

14. The method as recited in claim 13, further including an intermediate liner coupled with an uphole end of the multilateral junction, the intermediate liner including one or more intermediate liner sealing elements sealing an annulus between the intermediate liner and the main wellbore open hole section.

15. The method as recited in claim 14, wherein the one or more intermediate liner sealing elements are a first set of one or more intermediate liner sealing elements, and further including a second set of one or more intermediate liner sealing elements sealing the annulus between the intermediate liner and the main wellbore open hole section, the second set of one or more intermediate liner sealing elements laterally offset from the first set of one or more intermediate liner sealing elements.

16. The method as recited in claim 15, further including a main wellbore screen assembly positioned between the first set of one or more intermediate liner sealing elements and the second sets of one or more intermediate liner sealing elements.

17. The method as recited in claim 11, wherein no cement surrounds the multilateral junction.

18. The method as recited in claim 11, wherein the lateral wellbore is a first lateral wellbore and the lateral bore completion is a first lateral bore completion, and further including a second lateral wellbore extending from the main wellbore, the second lateral wellbore having a second lateral wellbore open hole section and a second lateral bore completion.

19. The method as recited in claim 18, wherein the multilateral junction is a first multilateral junction and the intersection is a first intersection, and further including a second multilateral junction positioned at a second intersection between the main wellbore open hole section of the main wellbore and the second lateral wellbore open hole section of the second lateral wellbore, the second multilateral junction including a second main bore leg forming a third pressure tight seal with the first multilateral junction and a fourth lateral bore leg forming a fourth pressure tight seal with the second lateral bore completion.

20. The method as recited in claim 19, further including one or more multilateral junction sealing elements sealing an annulus between the second multilateral junction and the main wellbore open hole section.

* * * * *